US009809919B2

(12) United States Patent
Yu et al.

(10) Patent No.: US 9,809,919 B2
(45) **Date of Patent: *Nov. 7, 2017**

(54) LAUNDRY TREATMENT APPARATUS

(71) Applicant: LG ELECTRONICS INC., Seoul (KR)

(72) Inventors: Insik Yu, Seoul (KR); Youngjun Kim, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 191 days.

This patent is subject to a terminal disclaimer.

(21) Appl. No.: 14/337,777

(22) Filed: Jul. 22, 2014

(65) Prior Publication Data

US 2015/0020550 A1 Jan. 22, 2015

(30) Foreign Application Priority Data

Jul. 22, 2013 (KR) ..... 10-2013-0086225
Jul. 22, 2013 (KR) ..... 10-2013-0086301

(51) Int. Cl.
*D06F 37/24* (2006.01)
*D06F 23/04* (2006.01)

(52) U.S. Cl.
CPC ..... *D06F 37/24* (2013.01); *D06F 23/04* (2013.01)

(58) Field of Classification Search
CPC ..... D06F 37/24; D06F 37/245
See application file for complete search history.

(56) References Cited

U.S. PATENT DOCUMENTS 5,528,913 A 6/1996 Savkar

FOREIGN PATENT DOCUMENTS

KR 20-1991-0003155 A1 5/1991
KR 20-1998-0025365 8/1998
KR 20-2000-0003812 2/2000
KR 20-0320745 A 7/2003

*Primary Examiner* — Jason Ko
(74) *Attorney, Agent, or Firm* — Dentons US LLP

(57) ABSTRACT

A laundry treatment apparatus includes a casing, an outer tub suspended in the casing, and a pair of horizontal vibration buffering devices arranged to form opposite angles relative each other in the casing, the horizontal vibration buffering devices each coupling a predetermined support disposed outside the outer tub with the outer tub and each having a portion connected with the outer tub to be displaced relative a portion connected with the predetermined support as the outer tub vibrates, where the pair of horizontal vibration buffering devices each provide an attenuation force according to the displacement.

21 Claims, 22 Drawing Sheets

(a)

(b)

LAUNDRY TREATMENT APPARATUS

CROSS-REFERENCE TO RELATED APPLICATION

This application claims the priority benefit of Korean Patent Application Nos. 10-2013-0086225, filed on Jul. 22, 2013, and No. 10-2013-0086301, filed Jul. 22, 2013, the disclosure of each is incorporated herein by reference in their entireties.

BACKGROUND

1. Field

The present disclosure relates to a laundry treatment apparatus having an outer tub with reduced horizontal vibration.

2. Description of the Related Art

A typical laundry treatment apparatus treats laundry by applying physical or chemical actions to the laundry and includes a washer that removes dirt from the laundry, a dehydrator that rotates, at high speed, the washing tub containing the laundry to dehydrate the laundry, and a dryer that supplies cool or hot air into the washing tub to dry the wet laundry.

A typical laundry treatment apparatus includes an outer tub supported and hung by a supporting rod in the casing and an inner tub rotating in the outer tub with laundry (or clothes) contained therein. A washer sometimes further includes a pulsator (or washing blades) that rotates in the inner tub. Such a configuration may cause the outer tub to vibrate when the pulsator spins. Accordingly, a typical laundry treatment apparatus has a device for mitigating vibration of the outer tub.

Conventionally, a buffering device is provided to connect the supporting rod with the outer tub. However, the buffering device primarily plays a role to reduce vertical vibration of the outer tub and does not work well enough to lessen horizontal vibration.

The recent trend of maximizing the volume of the outer tub without increasing the overall size of the laundry treatment apparatus, in order to increase use of the residential space leads to a decreased gap between the casing and the outer tub. However, as the gap between the casing and the outer tub decreases, the horizontal vibration is more likely to cause collision between the outer tub and the casing. Thus, a need exists for methods for effectively reducing the horizontal vibration of the outer tub.

SUMMARY

According to an embodiment of the present invention, a laundry treatment apparatus comprises: a casing: an outer tub suspended in the casing; and a pair of horizontal vibration buffering devices arranged to form opposite angles relative each other in the casing, the horizontal vibration buffering devices each coupling a predetermined support disposed outside the outer tub with the outer tub and each having a portion connected with the outer tub to be displaced relative a portion connected with the predetermined support as the outer tub vibrates, wherein the pair of horizontal vibration buffering devices each provide an attenuation force according to the displacement.

According to another embodiment of the present invention, a laundry treatment apparatus comprises: a casing; an outer tub suspended in the casing; and four horizontal vibration buffering devices, wherein a pair of the horizontal vibration buffering devices are arranged in the casing to face another pair of the horizontal vibration buffering devices to form opposite angles relative each other, each of the horizontal vibration buffering devices coupling a predetermined support positioned outside the outer tub with the outer tub, wherein a portion of each horizontal vibration buffering device connected with the outer tub relative a portion of each horizontal vibration buffering device connected with the predetermined support has a displacement as the outer tub vibrates, and wherein each of the four horizontal vibration buffering devices provides an attenuation force according to the displacement.

BRIEF DESCRIPTION OF THE DRAWINGS

The above and other objects, features, and other advantages of embodiments of the present invention will be more clearly understood from the following detailed description taken in conjunction with the accompanying drawings, in which.

DETAILED DESCRIPTION OF THE PREFERRED EMBODIMENTS

Advantages and features of embodiments of the present invention and a method of achieving the same will be more clearly understood from embodiments described below with reference to the accompanying drawings. However, the present invention is not limited to the following embodiments but may be implemented in various different forms. Wherever possible, the same reference numbers will be used throughout the specification to refer to the same or like parts.

Hereinafter, a washer is described as an example of the laundry treatment apparatus. However, the scope of the present invention is not limited thereto.

Figure 1:
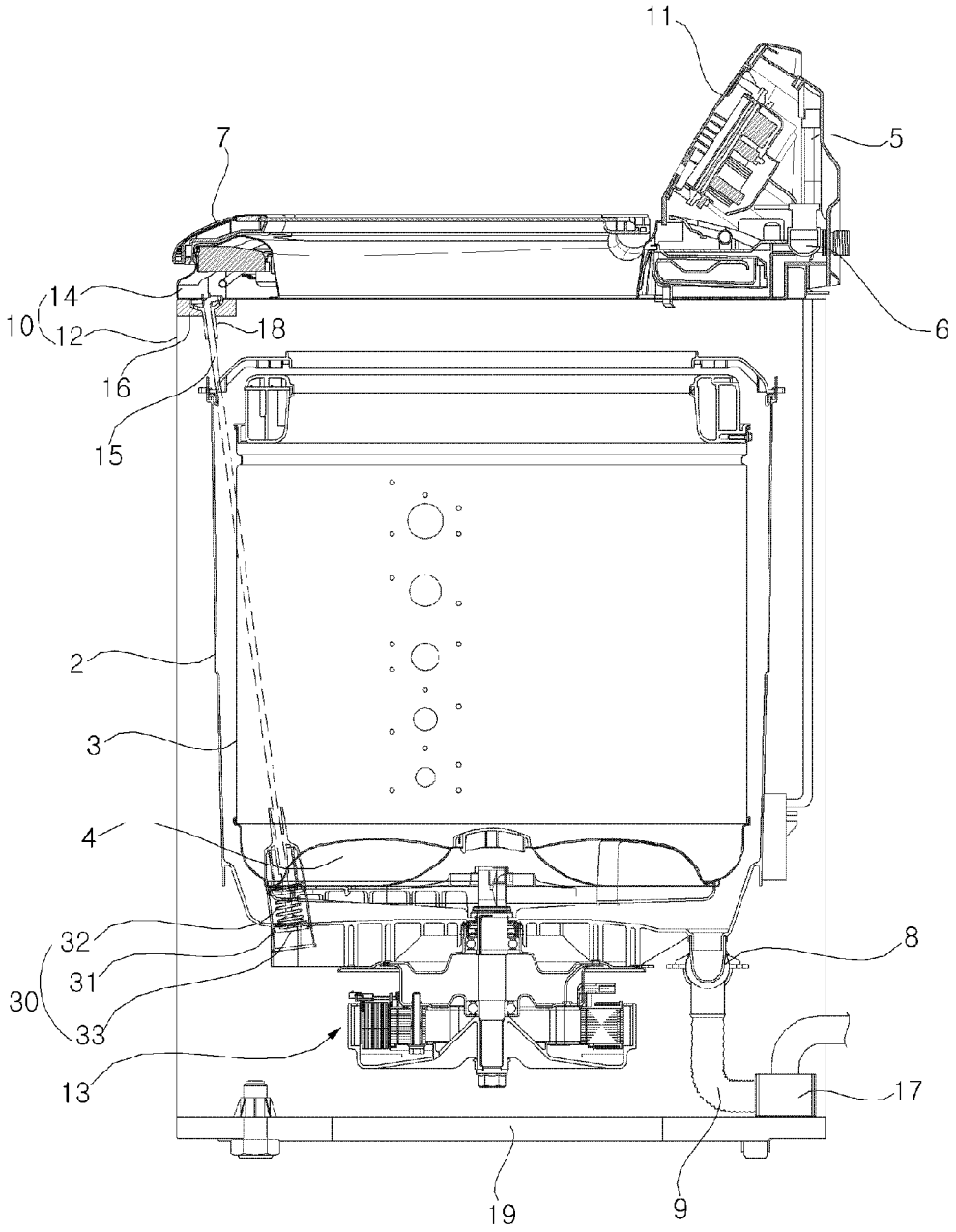
FIG. 1 is a view illustrating the inside of a washer according to an embodiment of the present invention.

FIG. 1 is a view illustrating the inside of a washer according to an embodiment of the present invention. Referring to FIG. 1, the washer according to an embodiment of the present invention includes a casing 10 forming an outer appearance of the washer, a control panel 11 having manipulation keys for receiving various control commands from a user and a display for displaying information on the operational state of the washer to provide a user interface, and a door 7 rotatably provided at the casing 10 to open and close an entrance/exit hole (not shown) through which laundry is entered or exited.

An outer tub 2 containing washing water is hung at the inside of the casing 10 by a supporting rod 15. An inner tub 3 receiving laundry is rotatably provided in the outer tub 2, and a pulsator 4 is rotatably provided on the bottom of the inner tub 3. The inner tub 3 includes a plurality of holes through which washing water passes.

The casing as defined herein may be of any type as long as it forms the outer appearance of the washer. In particular, the casing is preferably a fixture that does not move so that an end of the supporting rod 15 hanging the outer tub 2 may be fixed by the casing.

The casing 10 may include a main body 12 having an upper side opened, a base 19 supporting the main body 12, and a top cover 14 provided at the upper side of the main body 12 and having, substantially at a middle part thereof, an entrance/exit hole through which laundry is entered or exited.

A pivot support 16 is fixed to the casing 10 to provide support so that an end of the supporting rod 15 may pivot within a predetermined range. The pivot support 16 may be fixed by either the main body 12 or the top cover 14.

Another end of the supporting rod 15 is connected with the outer tub 2 by a vertical vibration buffering device 30. The vertical vibration buffering device 30 attenuates the vertical vibration of the outer tub 2 that occurs when the washer operates. Vertical vibration buffering device 30 may include a cap 31 fixed to an outer side surface of outer tub 2 and a spring 32 elastically deformed as the outer tub 2 vibrates. Supporting rod 15 penetrates cap 31. Supporting rod 15 has, at its end, a spring support 33 for supporting spring 32.

When outer tub 2 vibrates, cap 31, together with outer tub 2, moves up and down along supporting rod 15. While cap 31 moves together with outer tub 2, a buffering action is exerted by a frictional force between cap 31 and spring support 33, a viscous force generated while the air compressed as cap 31 moves out of the space between the inner circumferential surface of cap 31 and spring support 33, and elastic/restoring force as spring 32 elastically deforms.

Meanwhile, the other elements denoted with the reference numerals shown in FIG. 1 are described. A water supply path 5 is connected with an external water source, e.g., a faucet, to supply water to the inside of outer tub 2 and/or inner tub 3. A water supply valve 6 switches on/off the water supply path 5. A driver 13 drives inner tub 3 and/or the pulsator 4. A water discharge path 9 discharges washing water from the inside of outer tub 2. A water discharge valve 8 switches on/off water discharge path 9. A water discharge pump 17 pumps the washing water discharged to water discharge path 9 to the outside of the washer.

Figure 2:
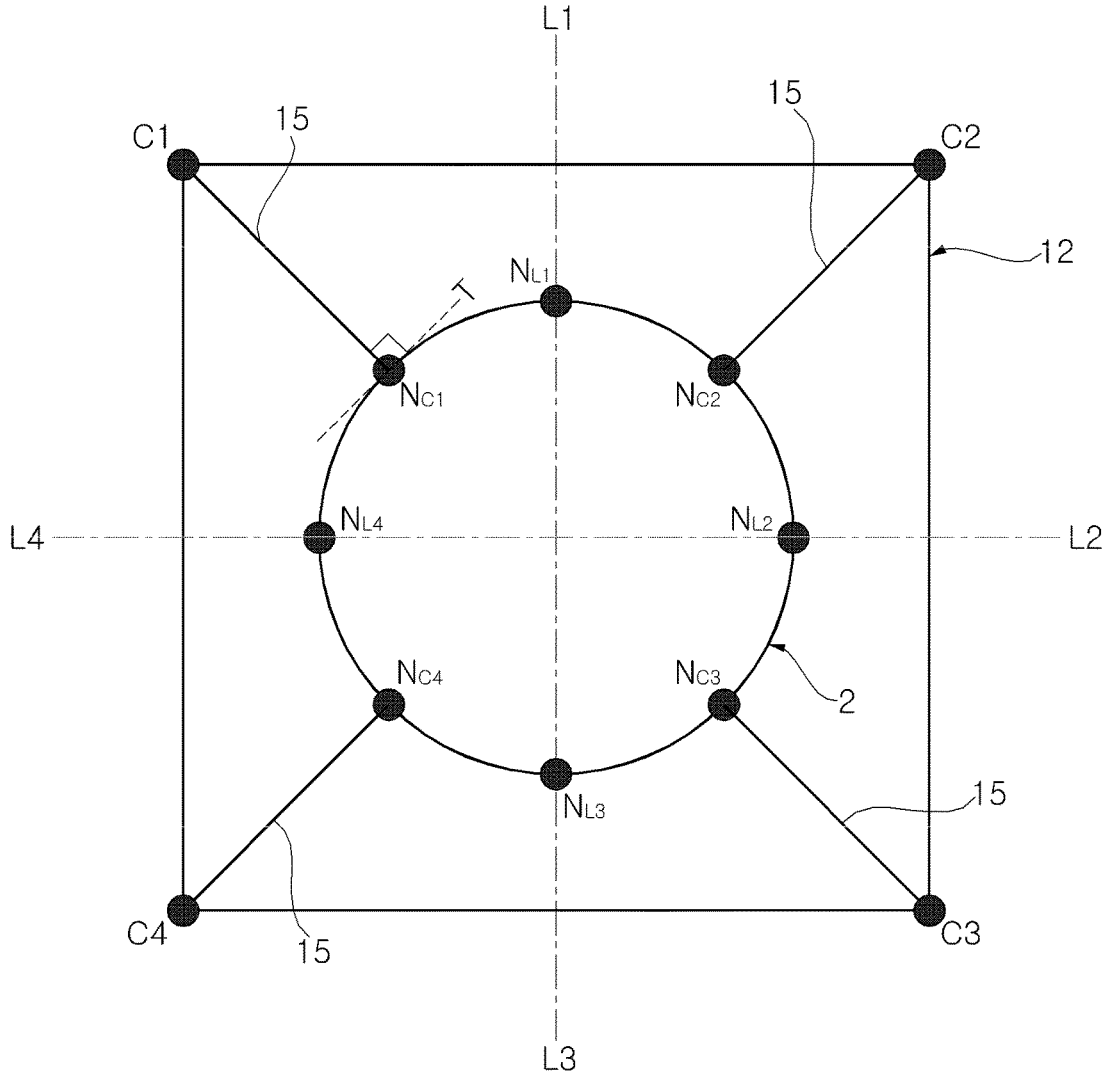
FIG. 2 is a view of the washer shown in FIG. 1, as viewed from above, which schematically illustrates, in particular, a cabinet, an outer tub, and supporting rods.
Figure 3:
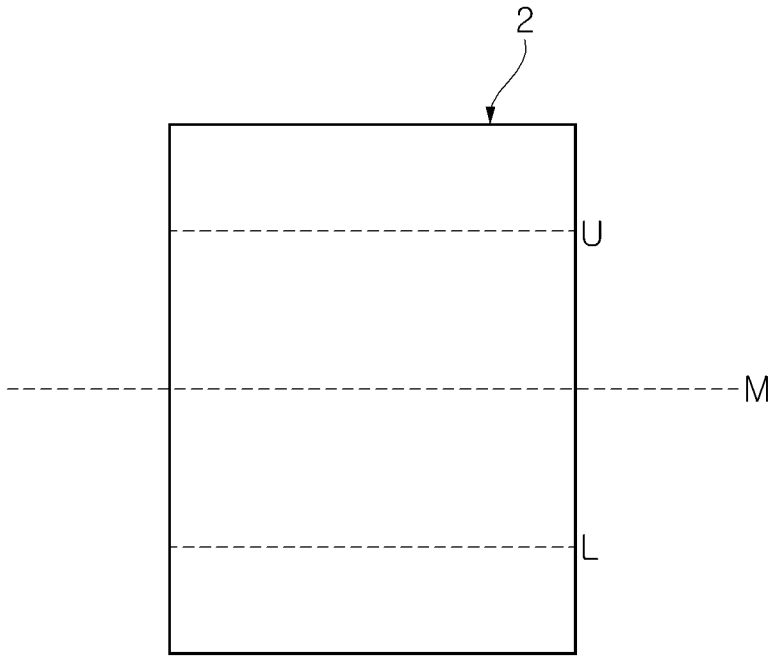
FIG. 3 is a side view of the outer tub shown in FIG. 2.

FIG. 2 is a view of the washer shown in FIG. 1, when viewed from above. In particular, FIG. 2 schematically shows the cabinet, outer tub, and supporting rod. FIG. 3 is a side view of the outer tub shown in FIG. 2.

Before detailing embodiments of the present invention, the terms are first defined in connection with FIGS. 2 and 3.

C1, C2, C3, and C4, respectively, denote four corners of a main body 12. An end of supporting rod 15 is pivotably connected with each corner. Such points are hereinafter referred to as corners (C), and the four corners, respectively, are denoted C1, C2, C3, and C4.

$N_{C1}$, $N_{C2}$, $N_{C3}$, and $N_{C4}$ are points on any circumference taken from the outer tub 2 and are points spaced apart from each other at substantially the same distance. These points are oriented towards the corners as viewed from the horizontal plane, and thus, are denoted corner facing points $N_c$, hereinafter. The four corner facing points, respectively, are denoted $N_{C1}$, $N_{C2}$, $N_{C3}$, and $N_{C4}$.

FIG. 2 illustrates the position of the points on the horizontal plane as outer tub 2 is viewed from above. Thus, although the circumference taken from outer tub 2 varies, the position of each point is shown as the same one in FIG. 2. However, the position of each point has a height in the vertical direction, and accordingly, the circumferences where the points, respectively, are arranged need to be shown. For this, the points have denotations U and L to distinguish each point from another, and such denotations are also used to denote relative heights between the components.

Specifically, in case two different circumferences U and L from each other are taken from outer tub 2, $N_{C1}$, $N_{C2}$, $N_{C3}$, and $N_{C4}$ in FIG. 3 may be denoted, on the circumference U, ($N_{C1}$, U), ($N_{C2}$, U), ($N_{C3}$, U), and ($N_{C4}$, U), respectively, which are hereinafter referred to as upper corner facing points ($N_C$, U). Likewise, the points on the circumference L may be denoted ($N_{C1}$, L), ($N_{C2}$, L), ($N_{C3}$, L), and ($N_{C4}$, L), respectively, which are hereinafter referred to as lower corner facing points ($N_C$, L). Here, the term "upper" or "lower" is used to merely define a relative position between points, and are not limited to specific positions. Hereinafter, the terms "upper" and "lower" which are used without referring to two points whose heights are compared with each other are referred to as upper side and lower side, respectively, with respect to a middle position (M, refer to FIG. 3) in the vertical direction of outer tub 2.

Preferably, the circumference U may be taken from an upper side of the position M, and the circumference L may be taken from a lower side of the center of mass (M), but the present invention is not limited thereto.

The corner facing points $N_C$ are arranged at the same distance along the circumference, and in particular, since outer tub 2 is hung by four supporting rods 15 connected to the lower corner facing points, supporting rods 15 are positioned balanced without being biased to a side with respect to the corner facing points in the normal state where no separate external force is applied. That is, the tangent to the circumference at each corner facing point $N_{C1}$, $N_{C2}$, $N_{C3}$, and $N_{C4}$ on the horizontal surface is substantially perpendicular to supporting rod 15. FIG. 2 shows an example where the tangent T to the circumference at the corner facing point $N_{C1}$ is perpendicular to supporting rod 15 connecting the corner facing point $N_{C1}$ with the corner C1. This is also true for supporting rods 15 provided at other corners C2, C3, and C4.

L1, L2, L3, and L4, respectively, refer to sides of main body 12, and $N_{L1}$, $N_{L2}$, $N_{L3}$, and $N_{L4}$ are defined as the closest points to the sides L1, L2, L3, and L4, respectively, on the circumference of outer tub 2. These points are hereinafter referred to as side nearby points ($N_L$), and the four side nearby points are denoted $N_{L1}$, $N_{L2}$, $N_{L3}$, and $N_{L4}$, respectively.

An end of a horizontal vibration buffering device is connected with outer tub 2, but according to an embodiment, the other end thereof is connected with a predetermined support disposed outside outer tub 2. Any support may be adopted as long as it may be connected with the horizontal vibration buffering device. In particular, outer tub 2 has a displacement with respect to the support when vibrated. Casing 10 or supporting rod 15 may be an example of the support.

Hereinafter, a portion of the horizontal vibration buffering device, which is connected with outer tub 2, is denoted an outer tub connecting part, and another portion thereof, which is connected with the support, is denoted a support connecting part. The support connecting part may include a supporting rod connecting part and a casing connecting part, according to embodiments. The supporting rod connecting part is defined as a portion of the horizontal vibration buffering device, which is connected with supporting rod 15, and the casing connecting part is defined as a portion of the horizontal vibration buffering device, which is connected with casing 10.

Figure 4:
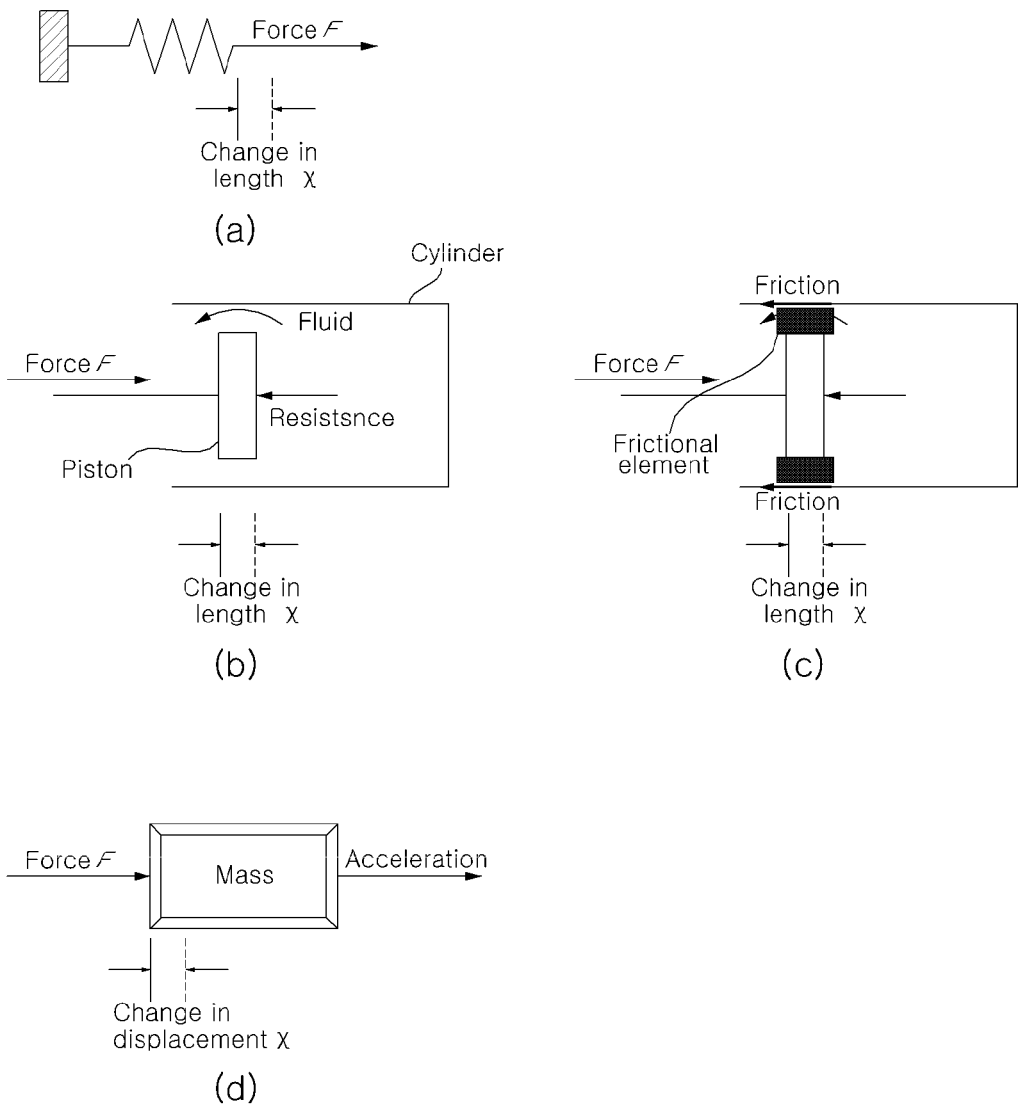
FIG. 4 is a free-body diagram in a spring-damper-mass system.

When outer tub 2 has a displacement due to vibration, the distance between the outer tub connecting part and the casing connecting part may vary depending on a displacement of a damper constituting the horizontal vibration buffering device—travelling distance of the piston with respect to the cylinder (refer to FIG. 4(*b*)) or travelling distance of a frictional member (refer to FIG. 4(*c*))—or the deformed distance of the spring (refer to FIG. 4(*a*)).

However, the travelling direction of outer tub 2 due to vibration continues to vary, and in this case, the outer tub connecting part moves alongside outer tub 2. Accordingly, in order to reduce interference between the outer tub connecting part and outer tub 2 or between the casing connecting part and casing 10, it is preferable that the outer tub connecting part is rotatably coupled with outer tub 2 and the casing connecting part is rotatably coupled with casing 10. In the following embodiments, unless mentioned otherwise, the outer tub connecting part is rotatably coupled with outer tub 2, and the casing connecting part is rotatably coupled with casing 10.

FIG. 4 is a free-body diagram in a spring-damper-mass system.

Generally, a movement of a mechanical system may be predicted through interpretation of a simplified mathematical model having spring, damper, and mass as its elements, i.e., a spring-damper-mass system. The spring means stiffness of the system, the damper means a reaction to an action such as friction or attenuation, and the mass means resistance or inertia to acceleration.

As mentioned hereinafter, the "buffering device" includes at least one of a damper and a spring to mitigate vibration of outer tub 2.

The spring may be defined as a mechanical element that may absorb or store energy using an elastic force that, when the element is deformed by application of a force, enables the element to move back to its original position.

Referring to FIG. 4(*a*), the stiffness of the spring is expressed as a relation between a force F extending and contracting the spring and a deformed length x, and the spring stiffness may be represented as follows in case the deformation of the spring is in proportion to the force exerted to the spring, like the case of a linear spring:

$$F=k\cdot x$$

k is a spring constant. As k increases, the force required to extend and contract the spring also increases, and this is referred to as the "stiffness is large." In view of energy, the spring stores energy when deformed and discharges energy when returning to the original position.

The damper is a device that absorbs vibrational energy, and in particular, is defined as a mechanical element to mitigate vibration or shock by scattering energy. While the spring continues to vibrate due to repetition of deformation and restoration, the damper dissipates energy by active frictional actions.

The damper creates an attenuation force (or resistance force) in an opposite direction of a displacement of an object, which is generated according to the vibration. Such attenuation force may include a drag force that is exerted from a fluid when an object moves in the fluid and a friction force that is exerted when attempting to move an object against friction.

FIG. 4(*b*) schematically shows such a type of damper that utilizes a drag force exerted from a fluid, wherein when a piston is on the move in the cylinder filled with the fluid, resistance is created when the fluid exits through a narrow gap. The resistance force at this time is generated primarily due to the viscosity of the fluid. The resistance force F is proportional to the velocity v.

$$F = cv = c\left(\frac{dx}{dt}\right)$$

Here, c is a viscous damping coefficient, and as c increases, the resistance force also increases.

FIG. 4(*c*) schematically shows such a type of damper that utilizes a friction force, wherein as a relative movement occurs between the piston and the cylinder due to the vibration of an object, a resistance force is created by a frictional member acting between the cylinder and the piston. The resistance force at this time is primarily a kinetic friction force, and the resistance force F is proportional to the drag force acting on the contacting surface from the frictional member.

$$F=\mu_k N$$

Here, $\mu_k$ is a kinetic friction coefficient.

The type of damper utilizing a drag force exerted from a fluid (refer to FIG. 4(*b*)) and the type of damper utilizing a friction force (refer to FIG. 4(*c*)) both have an attenuation force increasing in proportion to a coefficient (viscous damping coefficient c or kinetic friction coefficient $\mu_k$), and in this point of view, have common features. Hereinafter, the viscous damping coefficient or kinetic friction coefficient is defined as attenuation coefficient.

FIG. 4(*d*) schematically shows a motion of mass, wherein as the mass increases, the force required to generate a certain acceleration increases. According to Newton's second law, the relation between force F and acceleration a is F=ma, where the proportional coefficient between the force and the acceleration is mass m.

$$F = ma = m\left(\frac{dv}{dt}\right) = m\left(\frac{d^2x}{dt^2}\right)$$

Here, the force finally exerted to the mass, m, is the external force F from which the attenuation force ($F_d$) from the damper and the elastic force ($F_s$) from the spring are excluded. That is, it may be appreciated that as the mass m is considered as corresponding to outer tub 2, the force causing outer tub 2 to vibrate has an amount from which the attenuation force of the damper constituting the horizontal vibration buffering device and the elastic force of the spring have been excluded.

In the system, energy is required to deform the spring, accelerate the mass, and make the damper act. Although the mass and the spring may regain energy, the damper's energy is consumed out.

The spring, when deformed, retains energy, and when restored to its original position, releases energy. At this time, the energy $E_s$ retained by the spring as the spring is deformed by displacement x is ½ kx^2. Since F=kx, the spring energy may be expressed as follows:

$$E_S = \frac{1}{2}\frac{F_s^2}{k}$$

When an object moves at speed v, the mass retains the energy in the form of kinetic energy ($E_k$). This energy is released when the mass stops moving.

$$E_K = \frac{1}{2}mv^2$$

The damper consumes the energy in the form of heat or noise without retaining. The damper, when the external force exerted thereto is removed, does not return to its original position. In the case of damper performing an attenuating function by the viscosity of a fluid, the power $P_y$ dissipated by velocity v may be represented as follows:

$$P_v=cv^2$$

In the case of damper dissipating vibrational energy in the form of friction energy ($E_f$) may be represented as follows:

$$E_f=\mu_k\int F_f(x)dX$$

In the following embodiments described in connection with FIGS. 5 through 22, although not shown in the drawings, supporting rod 15, unless mentioned otherwise, is deemed as connected with outer tub 2 by way of a vertical vibration buffering device 30.

The spring-damper-mass system described thus far may be used to interpret the vibration of outer tub 2. The force to mitigate vibration of the mass, m, of the components hung in casing 10 by supporting rods 15 comes from the attenuation force ($F_d$) and/or elastic force ($F_s$) of the damper and/or spring, respectively, constituting the horizontal vibration buffering device.

Figure 5:
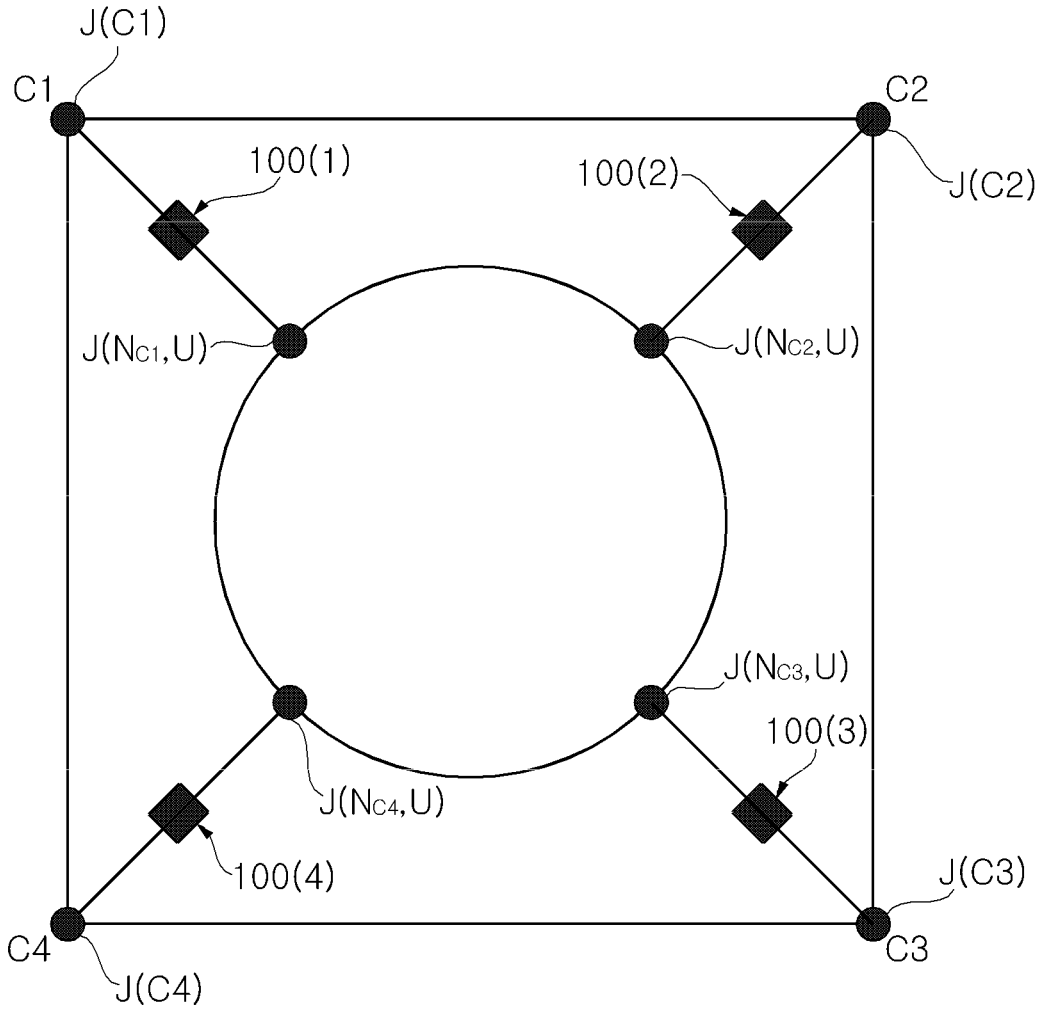
FIG. 5 is a view illustrating the configuration of horizontal vibration buffering devices of a washer according to a first embodiment of the present invention.

FIG. 5 shows a configuration of a horizontal vibration buffering device of a washer according to a first embodiment of the present invention. Referring to FIG. 5, in the washer according to this embodiment, each corner C is connected with the lower part L of outer tub 2 by supporting rod 15, and each corner C is connected with the upper part U of outer tub 2 by horizontal vibration buffering device 100. At this time, the supporting rods 15 may be connected to the lower corner facing points $N_C$, L on the circumference L of outer tub 2, and horizontal vibration buffering devices 100 may be connected to the upper corner facing points $N_C$, U on the circumference U.

In the instant embodiment, the horizontal vibration buffering devices 100 are positioned symmetrical to each other with respect to the center of outer tub 2, i.e., the horizontal vibration buffering devices 100 are provided to form opposite angles with respect to the center of outer tub 2. Two horizontal vibration buffering devices 100(1) and 100(3) or 100(2) and 100(4) or four horizontal vibration buffering devices 100(1), 100(2), 100(3), and 100(4) may be provided.

In case two horizontal vibration buffering devices (for example, 100(1) and 100(3)) are present, any one 100(1) thereof may connect the corner C1 with the upper corner facing point $N_{C1}$, U, and the other 100(3) may connect the corner C3 with the upper corner facing point $N_{C3}$, U.

In one embodiment, when the two horizontal vibration buffering devices 100(1) and 100(3) are arranged to form opposite angles with respect to each other, any one 100(1) may include a damper, and the other 100(3) may include a spring. Since the damper and the spring are arranged to form opposite angles with respect to each other, if outer tub 2 vibrates, and thus, the damper has a displacement in any one direction, an elastic force is accumulated in the spring, which is used to return the damper to the original position.

The opposite-angle arrangement between the spring and the damper may also apply to the case where four horizontal vibration buffering devices 100(1), 100(2), 100(3), and 100(4) are provided, and in such case, any one of the two horizontal vibration buffering devices arranged to form opposite angles with respect to each other may include a spring while the other may include a damper.

Meanwhile, according to an embodiment, horizontal vibration buffering devices that provide an attenuation force as outer tub 2 is vibrated may be arranged to form opposite angles with respect to each other.

For example, in case two horizontal vibration buffering devices are provided to form opposite angles with respect to each other, each horizontal vibration buffering device provides an attenuation force according to a displacement of an outer tub connecting part with respect to a support connecting part connected with supporting rod 15 or support (casing 2) disposed outside outer tub 2.

the outer tub connecting part with respect to the support connecting part is identical.

Table 1 summarizes the configurations of the four horizontal vibration buffering devices. D means a damper, and S means a spring. D+S or D+S1 (or S2) means that one horizontal vibration buffering device includes both a damper and a spring, and the damper and the spring may be connected with each other in series or parallel with each other. Springs S1 and S2 may have different coefficient spring constants from each other (k1≠k2).

TABLE 1

| | Configuration 1 | Configuration 2 | Configuration 3 | Configuration 4 | Configuration 5 | Configuration 6 | Configuration 7 |
|---|---|---|---|---|---|---|---|
| Horizontal vibration buffering device (100(1), 200(1), 100a(1), 200a(1) or 300(1)) | D | D | D + S | D | D + S | D + S1 | D |
| Horizontal vibration buffering device (100(2), 200(2), 100b(1), 200b(1) or 300(2)) | D | S | D | D | D + S | D + S2 | D |
| Horizontal vibration buffering device (100(3), 200(3), 100a(3), 200a(3) or 300(3)) | S | D | D + S | D + S | D + S | D + S1 | D |
| Horizontal vibration buffering device (100(4), 200(4), 100b(3), 200b(3) or 300(4)) | S | S | D | D + S | D + S | D + S2 | D |

It is preferable that each horizontal vibration buffering device provides the same attenuation force when the displacement is identical. Each of the horizontal vibration buffering devices may include a damper that offers an attenuation force according to a displacement of the outer tub connecting part with respect to the support connecting part, and each damper may have the same attenuation coefficient. Here, the phrase "horizontal vibration buffering device includes a damper" does not necessarily mean that the horizontal vibration buffering device includes only a damper. The horizontal vibration buffering device may also include a spring as well as a damper. In such case, however, the dampers provided in the pair of horizontal vibration buffering devices have the same attenuation coefficient so as to provide the same magnitude of attenuation force when the displacement of the outer tub connecting part with respect to the support connecting part is identical.

In case four horizontal vibration buffering devices 100(1), 100(2), 100(3), and 100(4) are provided, the horizontal vibration buffering devices all may offer an attenuation force. Each of the four horizontal vibration buffering devices 100(1), 100(2), 100(3), and 100(4) may include a damper.

Preferably, among the four horizontal vibration buffering devices, any pair of horizontal vibration buffering devices arranged to form opposite angles with respect to each other may have the same attenuation coefficient, so that they may provide the same attenuation force when the displacement of Horizontal vibration buffering devices 100 may have outer tub connecting parts and casing connecting parts. The outer tub connecting parts are connected with an upper part U of outer tub 2, in particular with upper corner facing points. In FIG. 5, J($N_{C1}$, U), J($N_{C2}$, U), J($N_{C3}$, U), and J($N_{C4}$, U) denote the outer tub connecting parts of the horizontal vibration buffering devices 100(1), 100(2), 100(3), and 100(4), respectively.

The casing connecting part may be connected with the corner C of the casing 10. In FIG. 5, J(C1), J(C2), J(C3), and J(C4) denote the casing connecting parts of the horizontal vibration buffering devices 100(1), 100(2), 100(3), and 100(4), respectively.

Figure 6:
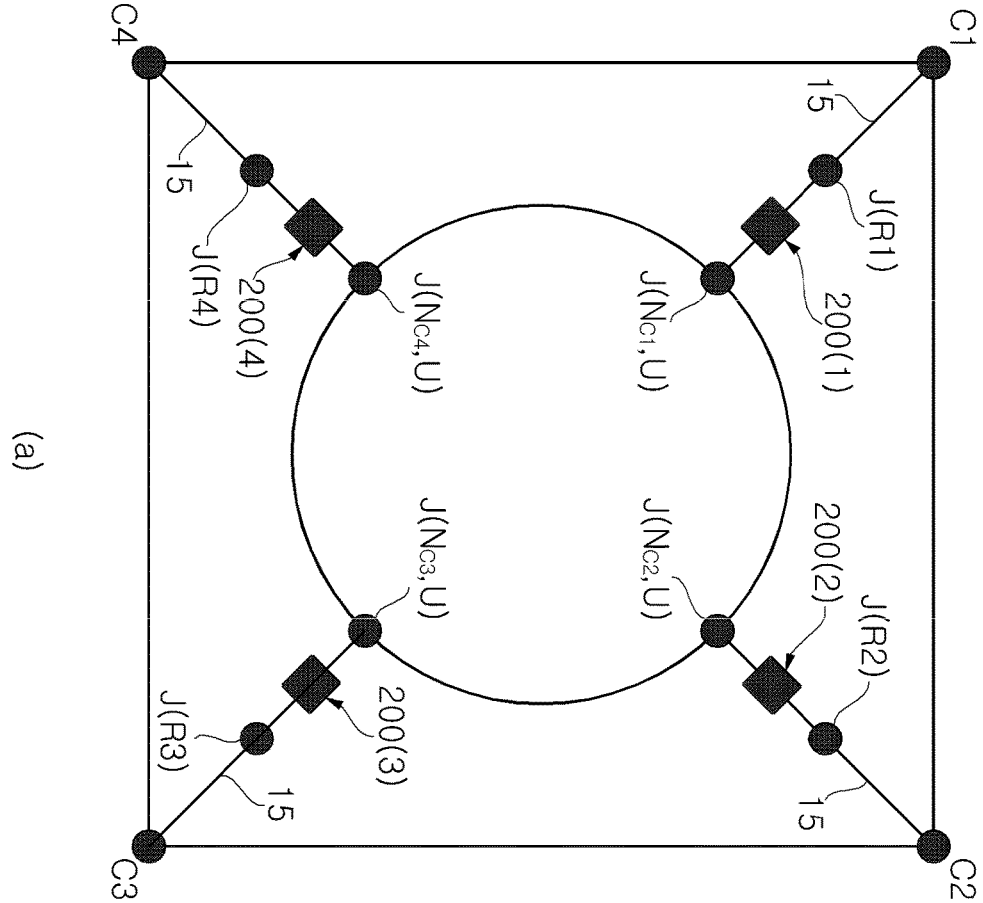
FIG. 6 is a view illustrating the configuration of horizontal vibration buffering devices of a washer according to a second embodiment of the present invention.
Figure 6:
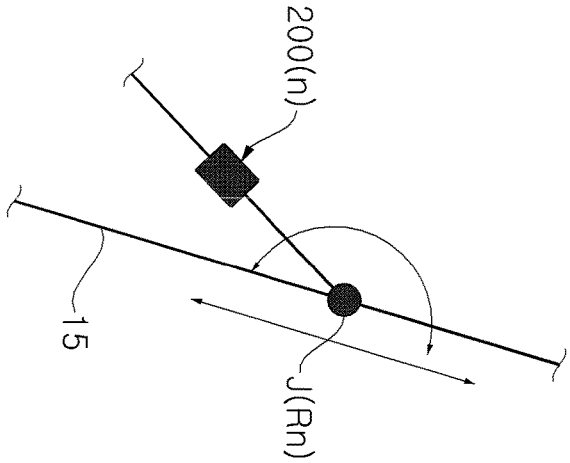

FIG. 6 illustrates the configuration of horizontal vibration buffering devices of a washer according to a second embodiment of the present invention.

In the laundry treatment apparatus according to an embodiment of the present invention, the same description given for the embodiments described above in connection with FIGS. 1 to 5 may apply to the configuration and mutual relation in arrangement between the plurality of horizontal vibration buffering devices except that the horizontal vibration buffering devices 200 each include a supporting rod connecting part J(R). In FIG. 6, J(R1), J(R2), J(R3), and J(R4), respectively, denote the respective supporting rod connecting parts (J(Rn), n=1, 2, 3, and 4) of the horizontal vibration buffering devices 200(1), 200(2), 200(3), and 200(4).

The supporting rod connecting part J(R) is provided to be able to move along supporting rod 15. For example, any one of a piston and a cylinder constituting a damper is connected with outer tub 2, and the other is connected with supporting rod 15, so that the supporting rod connecting part J(Rn) may be moved along supporting rod 15 as the distance between the piston and the cylinder varies.

Further, horizontal vibration buffering device 200 may be rotated about supporting rod connecting part J(Rn). In such case, the supporting rod connecting part J(Rn) moves and rotates, and thus, has a degree of freedom of at least 2 (refer to FIG. 6(*b*)).

The springs or dampers constituting horizontal vibration buffering devices 200(1), 200(2), 200(3), and 200(4) may have the combinations as shown in Table 1.

Figure 7:
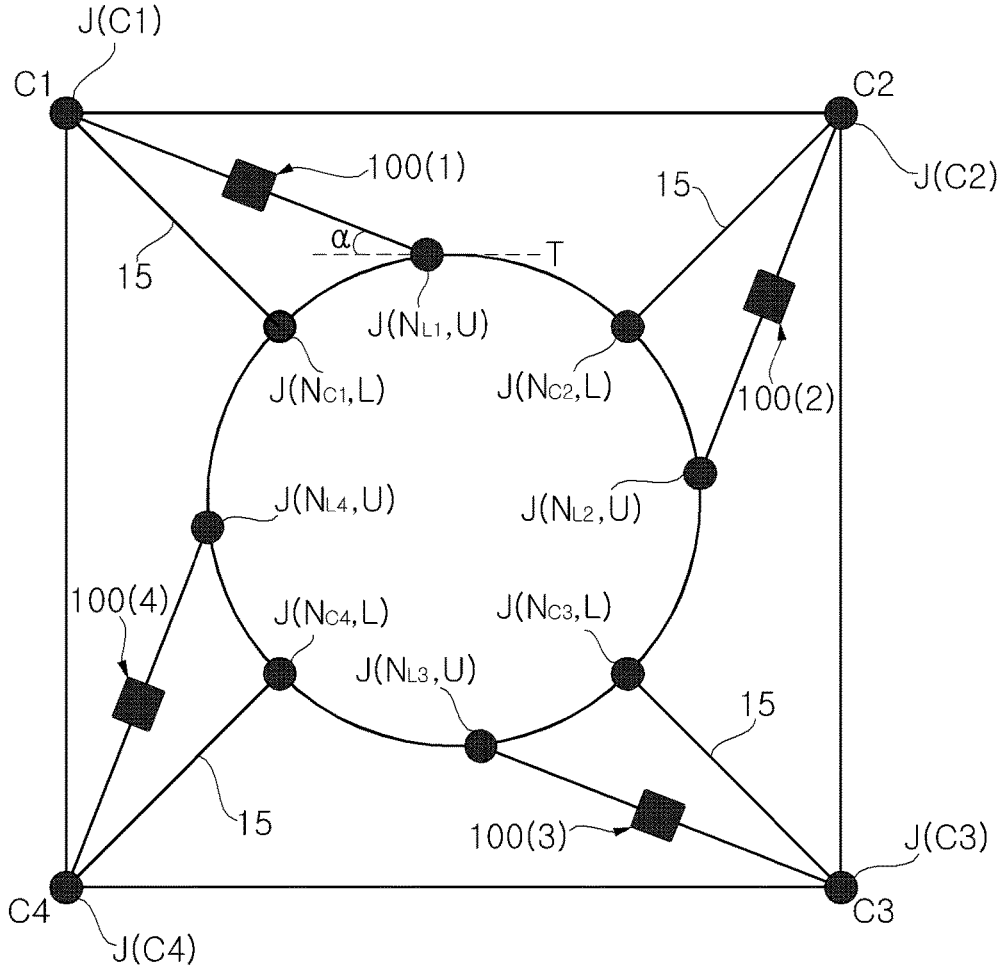
FIG. 7 is a view illustrating the configuration of horizontal vibration buffering devices of a washer according to a third embodiment of the present invention.

FIG. 7 illustrates the configuration of horizontal vibration buffering devices of a washer according to a third embodiment of the present invention.

In the washer according to this embodiment, horizontal vibration buffering devices 100 are connected with points on any circumference taken from outer tub 2, and an acute angle $\alpha$ is formed between the tangent T to the circumference and the horizontal vibration buffering device 100 on the horizontal surface.

A plurality of horizontal vibration buffering devices 100 may be provided, and the plurality of horizontal vibration buffering devices include at least one pair of horizontal vibration buffering devices 100(1) and 100(3) or 100(2) and 100(4) that are arranged to form opposite angles with respect to each other.

Preferably, the outer tub connecting parts of the horizontal vibration buffering devices 100(1) and 100(3) or 100(2) and 100(4) are connected with the upper part U of outer tub 2. In FIG. 7, each horizontal vibration buffering device 100(1), 100(2), 100(3), or 100(4) has an outer tub connecting part J($N_{L1}$, U), J($N_{L2}$, U), J($N_{L3}$, U), or J($N_{L4}$, U) connected with the upper side nearby point, but without limited thereto, may be connected with any point between the corner facing point Nc and the side nearby point $N_L$.

The same description given in connection with Table 1 may apply to any combinations of the dampers D and springs S constituting the horizontal vibration buffering devices 100(1), 100(2), 100(3), and 100(4), and detailed description thereof is skipped.

Among the horizontal vibration buffering devices 100(1), 100(2), 100(3), and 100(4), the ones connected with their opposite corners are arranged symmetrically with respect to the center of outer tub 2. Horizontal vibration buffering device 100(1) and horizontal vibration buffering device 100(3) are arranged to be symmetrical with each other, and horizontal vibration buffering device 100(2) and horizontal vibration buffering device 100(4) are arranged to be symmetrical with each other.

Figure 8:
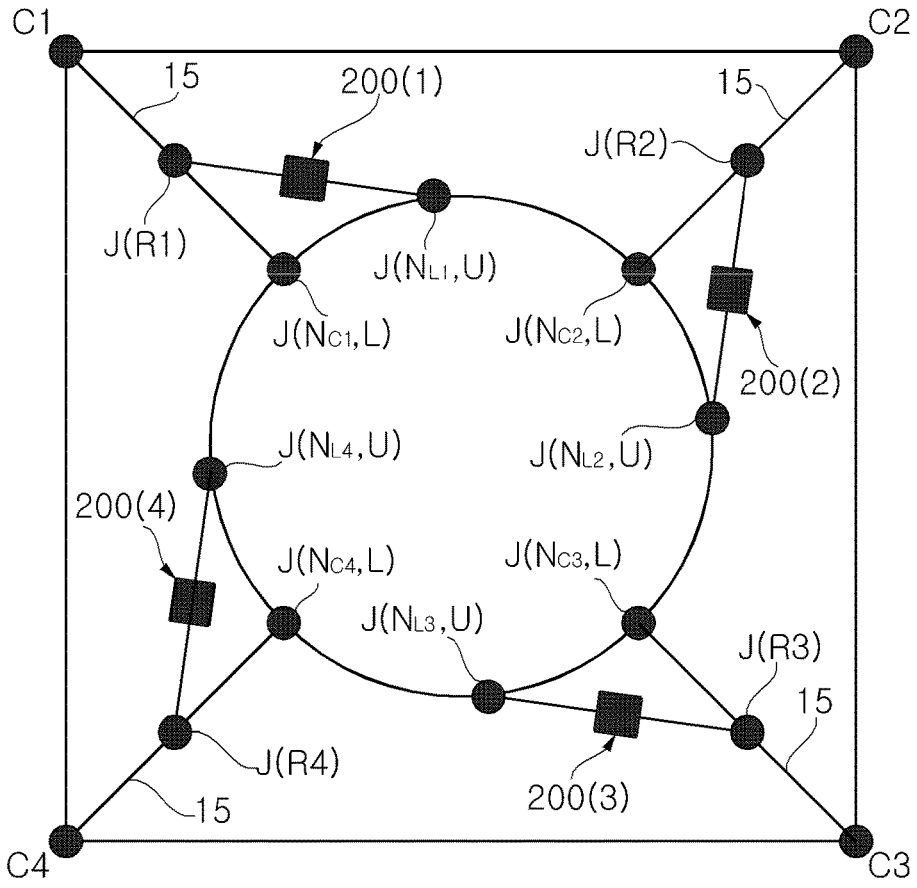
FIG. 8 is a view illustrating the configuration of horizontal vibration buffering devices of a washer according to a fourth embodiment of the present invention.

FIG. 8 illustrates the configuration of horizontal vibration buffering devices of a washer according to a fourth embodiment of the present invention.

The description given above in connection with the third embodiment may likewise apply to the configuration and mutual relation in arrangement between the plurality of horizontal vibration buffering devices according to this embodiment except that the horizontal vibration buffering devices 200(1), 200(2), 200(3), and 200(4) have supporting rod connecting parts J(R1), J(R2), J(R3), and J(R4), respectively.

The supporting rod connecting parts J(R1), J(R2), J(R3), and J(R4) are provided movably along supporting rods 15. For example, any one of a piston and a cylinder constituting a damper is connected with outer tub 2, and the other is connected with supporting rod 15, so that the supporting rod connecting part J(R1), J(R2), J(R3), or J(R4) may be moved along supporting rod 15 as the distance between the piston and the cylinder varies.

Further, horizontal vibration buffering device 200(1), 200(2), 200(3), or 200(4) may be rotated with respect to the supporting rod connecting part J(R1), J(R2), J(R3), or J(R4). If the supporting rod connecting part J(R1), J(R2), J(R3), or J(R4) both moves and rotates, it has a degree of freedom of at least 2.

Among horizontal vibration buffering devices 200(1), 200(2), 200(3), and 200(4), the ones connected with their opposite corners are arranged to be symmetrical with each other with respect to the center of outer tub 2. Horizontal vibration buffering device 200(1) and horizontal vibration buffering device 200(3) are arranged to be symmetrical with each other, and horizontal vibration buffering device 200(2) and horizontal vibration buffering device 200(4) are arranged to be symmetrical with each other.

The springs S or dampers D constituting the horizontal vibration buffering devices 200(1), 200(2), 200(3), and 200(4) may have the combinations as shown in Table 1.

Figure 9:
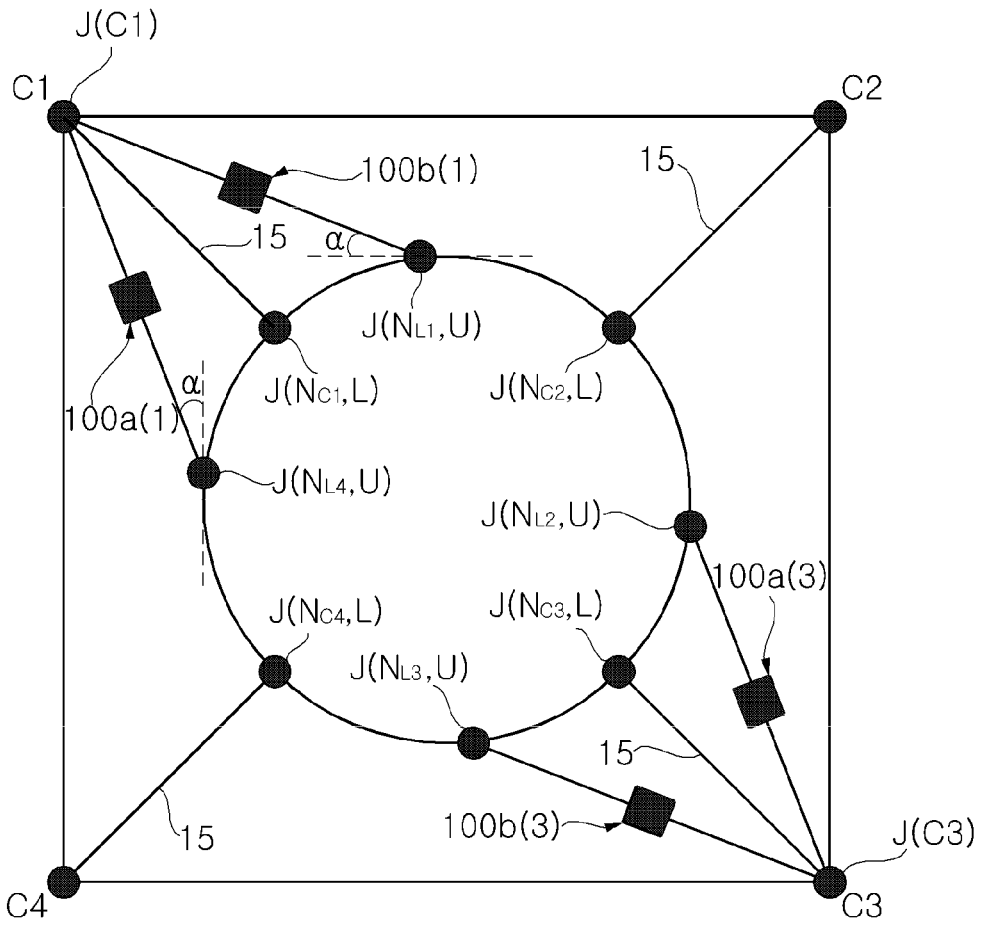
FIG. 9 is a view illustrating the configuration of horizontal vibration buffering devices of a washer according to a fifth embodiment of the present invention.

FIG. 9 illustrates the configuration of horizontal vibration buffering devices of a washer according to a fifth embodiment of the present invention.

The washer according to this embodiment and the washer according to the third embodiment are identical to each other in that horizontal vibration buffering device 100 is connected with outer tub 2 while forming an acute angle therebetween, but differ from each other in that at least two horizontal vibration buffering devices 100*a*(1) and 100*b*(1) are connected with one corner C1, at least two horizontal vibration buffering devices 100*a*(3) and 100*b*(3) are connected with the corner C3 arranged to form opposite angles with respect to the corner, and that there is provided another horizontal vibration buffering device 100*b*(1) that forms an acute angle (denoted '−a' in FIG. 9) in an opposite direction of an acute angle (denoted '+a' in FIG. 9) between the tangent to the circumference of outer tub 2 and any one of the two or more horizontal vibration buffering devices connected with one corner C1.

The springs S or dampers D constituting the horizontal vibration buffering devices 100*a*(1), 100*b*(1), 100*a*(3), and 100*b*(3) may have the combinations as shown in Table 1.

Figure 10:
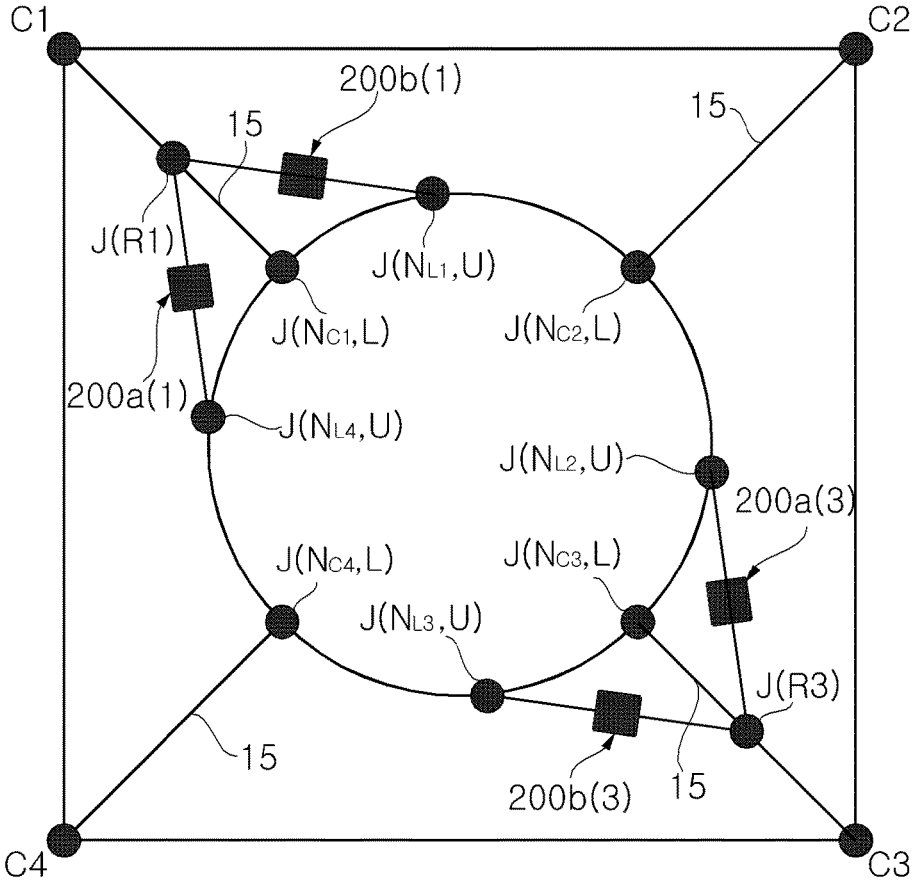
FIG. 10 is a view illustrating the configuration of horizontal vibration buffering devices of a washer according to a sixth embodiment of the present invention.

FIG. 10 illustrates the configuration of horizontal vibration buffering devices of a washer according to a sixth embodiment of the present invention.

The same description given above in connection with the fifth embodiment may likewise apply to the configuration and mutual relation in arrangement between the plurality of horizontal vibration buffering devices except that the horizontal vibration buffering devices 200*a*(1), 200*b*(1), 200*a*(3), and 200*b*(3) have supporting rod connecting parts J(R1) and J(R3).

The supporting rod connecting parts J(R1) and J(R3) are provided movably along supporting rods 15. For example, any one of a piston and a cylinder constituting a damper may be connected with outer tub 2, and the other may be connected with supporting rod 15, so that the supporting rod connecting parts J(R1) and J(R3) may be moved along supporting rods 15 as the distance between the cylinder and the piston varies.

Further, horizontal vibration buffering devices 200*a*(1), 200*b*(a), 200*a*(3), and 200*b*(3) may be rotated about supporting rod connecting parts J(R1) and J(R3). If the supporting rod connecting parts J(R1) and J(R3) both move and rotate, they have a degree of freedom of at least 2.

Among horizontal vibration buffering devices 100*a*(1), 100*b*(1), 100*a*(3), and 100*b*(3), the ones connected with their opposite corners are arranged to be symmetrical with each other with respect to the center of outer tub 2. For example, horizontal vibration buffering device 100*a*(1) and horizontal vibration buffering device 100*a*(3) are arranged to be symmetrical with each other, and horizontal vibration buffering device 100*b*(1) and horizontal vibration buffering device 100*b*(3) are arranged to be symmetrical with each other.

The springs S or dampers D constituting horizontal vibration buffering devices 200*a*(1), 200*b*(1), 200*a*(3), and 200*b*(3) may have the combinations as shown in Table 1.

Figure 11:
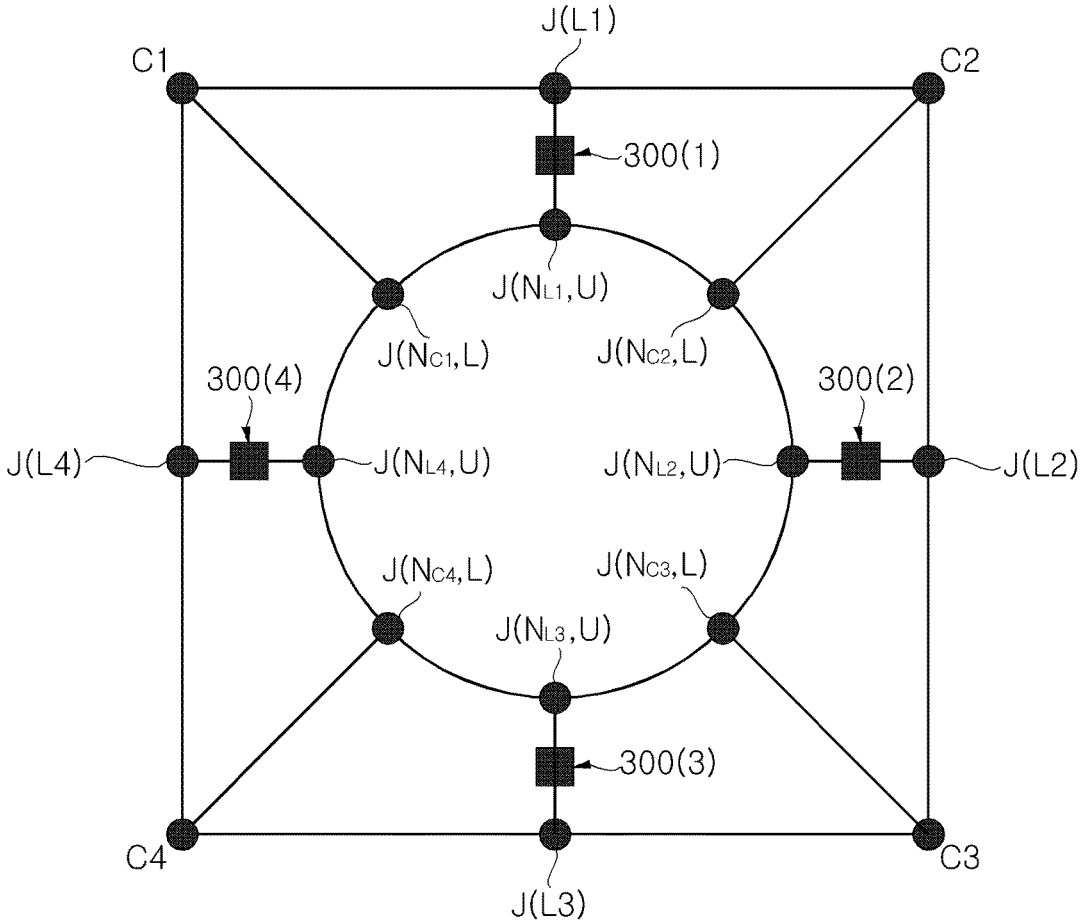
FIG. 11 is a view illustrating the configuration of horizontal vibration buffering devices of a washer according to a seventh embodiment of the present invention.

FIG. 11 illustrates the configuration of horizontal vibration buffering devices of a washer according to a seventh embodiment of the present invention.

In the washer according to this embodiment of the present invention, horizontal vibration buffering devices 300 connect outer tub 2 with side surfaces L of the cabinet. A plurality of horizontal vibration buffering devices 300(1), 300(2), 300(3), and 300(4) may be provided to connect the side surfaces L1, L2, L3, and L4 of main body 12 with outer tub 2. The plurality of horizontal vibration buffering devices are preferably arranged to be symmetrical with each other with respect to the center of outer tub 2.

Horizontal vibration buffering devices 300(1), 300(2), 300(3), and 300(4) have outer tub connecting parts and casing connecting parts. Preferably, the outer tub connecting parts are connected with an upper part U of outer tub 2. Horizontal vibration buffering devices 300(1), 300(2), 300(3), and 300(4) may have outer tub connecting parts J($N_{L1}$, U), J($N_{L2}$, U), J($N_{L3}$, U), and J($N_{L4}$, U) connected with upper part side nearby points ($N_L$, U).

The casing connecting parts J(L1), J(L2), J(L3), and J(L4) are preferably connected with the upper parts of the side surfaces L1, L2, L3, and L4 of main body 12. Here, the "upper parts" of the side surfaces L1, L2, L3, and L4 of main body 12 may be defined as portions which are higher than the middle position M of outer tub 2.

The springs or dampers D constituting the horizontal vibration buffering devices 300(1), 300(2), 300(3), and 300(4) may have the combinations as shown in Table 1.

FIGS. 12 to 24 referenced by the following embodiments do not show all of the horizontal vibration buffering devices constituting a washer but only representative ones that more clearly show the features of each embodiment. Among the components, some are denoted n, where n may be 1, 2, 3, or 4. What is illustrated in FIG. 2 applies to the components distinguished from each other by their respective numerals. For example, $N_{Cn}$, in FIG. 12 may be defined as any one of $N_{C1}$ through $N_{C4}$ of FIG. 2.

Figure 12:
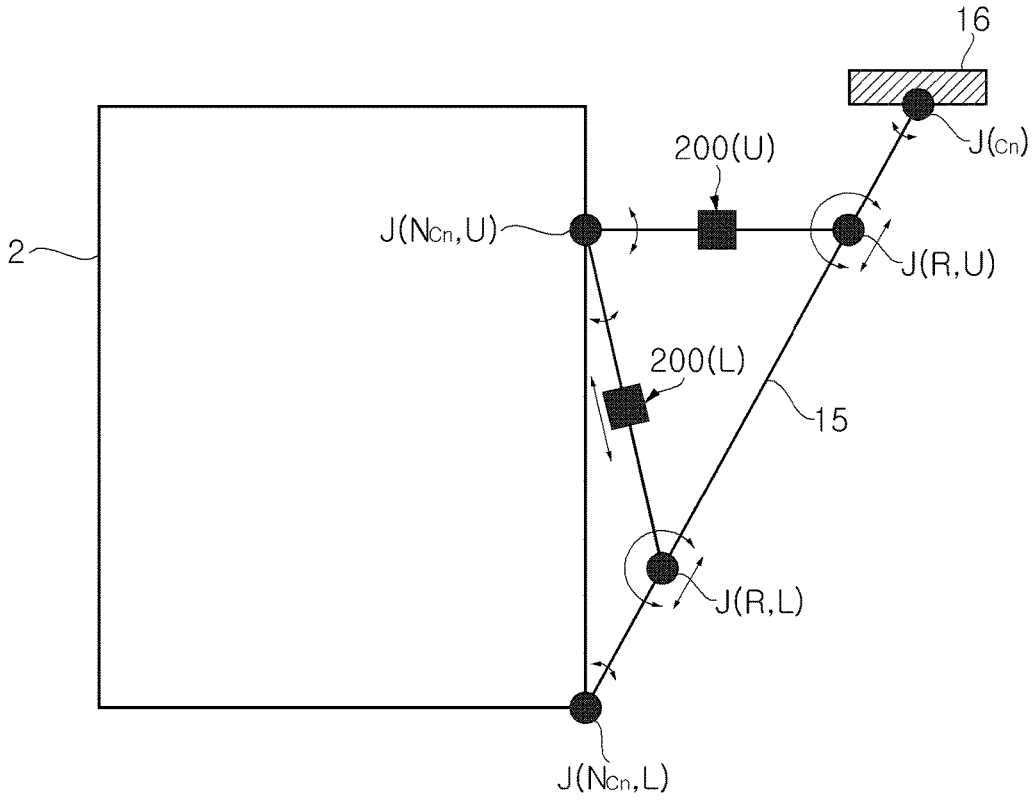
FIG. 12 is a view illustrating the configuration of horizontal vibration buffering devices of a washer according to an eighth embodiment of the present invention.

In the embodiments described in connection with FIGS. 12 and 13, a first horizontal vibration buffering device 200(U) or 300(U) and a second horizontal vibration buffering device 200(L) or 300(L) each having an end (outer tub connecting part) connected with an upper part of outer tub 2 are provided, and according to an embodiment, the other end of the first horizontal vibration buffering device is connected with an upper part of supporting rod 15 or an upper part of casing 10 while the other end of the second horizontal vibration buffering device is connected with a lower part of supporting rod 15 or a lower part of casing 10. Here, the "lower part" of supporting rod 15 or casing 10 may be defined as a portion that is lower than a middle position M of outer tub 2.

The first horizontal vibration buffering device 200(U) has a supporting rod connecting part J(R,U) that moves in an upper section of supporting rod 15, and the second horizontal vibration buffering device 200(L) has a supporting rod connecting part J(R,L) that moves in a lower section as compared with the first horizontal vibration buffering device 200(U).

The outer tub connecting parts of the first horizontal vibration buffering device 200(U) and the second horizontal vibration buffering device 200(L) are connected with an upper part of outer tub 2. Although in FIG. 12 the first horizontal vibration buffering device 200(U) and the second horizontal vibration buffering device 200(L) have a common outer tub connecting part J($N_{Cn}$, U) connected with the upper part of outer tub 2, the present invention is not limited thereto, and according to an embodiment, the first horizontal vibration buffering device 200(U) and the second horizontal vibration buffering device 200(L) each may have its own outer tub connecting part.

While the outer tub connecting part J($N_{Cn}$, U) may be a fixed connecting part that permits rotation of each of the horizontal vibration buffering devices 200(U) and 200(L), the supporting rod connecting parts J(R,U) and J(R,L) of the horizontal vibration buffering devices may be fixed connecting parts or movable connecting parts that permit not only rotation but also movement along supporting rod 15.

The supporting rod connecting parts J(R,U) and J(R,L), whether they are fixed connecting parts or movable connecting parts, are arranged in an upper-lower direction with respect to each other. In case each supporting rod connecting part J(R,U) or J(R,L) is a fixed connecting part with respect to supporting rod 15, the upper part and the lower part may be distinguished from each other with respect to the fixed position, but in case each supporting rod connecting part is a movable connecting part, the supporting rod connecting part J(R,U) of the first horizontal vibration buffering device 200(U) is allowed to move in an upper section as compared with the supporting rod connecting part J(R,L) of the second horizontal vibration buffering device 200(L).

According to another embodiment of the present invention, the first horizontal vibration buffering device 200(U) and the second horizontal vibration buffering device 200(L) each may have a damper. In such case, the attenuation constant of the first horizontal vibration buffering device 200(U) is preferably larger than the attenuation constant of the second horizontal vibration buffering device 200(L) so that a larger attenuation force may be generated by the first horizontal vibration buffering device 200(U).

According to yet another embodiment, the first horizontal vibration buffering device 200(U) may have a damper, and the second horizontal vibration buffering device 200(L) may have a spring. In such case, vibrations are attenuated by the first horizontal vibration buffering device 200(U), and the spring of the second horizontal vibration buffering device 200(L) provides an elastic force that restores the damper to its original state.

According to still another embodiment, the first horizontal vibration buffering device 200(U) and the second horizontal vibration buffering device 200(L) each may have a damper and a spring, so that the first horizontal vibration buffering device 200(U) exerts a larger attenuation force than the second horizontal vibration buffering device 200(L), and the second horizontal vibration buffering device 200(L) has a larger stiffness than the first horizontal vibration buffering device 200(U). That is, assuming that the attenuation constant and spring constant of the first horizontal vibration buffering device 200(U) are c1 and k1, respectively, and the attenuation constant and spring constant of the second horizontal vibration buffering device 200(L) are c2 and k2, respectively, the following relation is established:

$$c1>c2, k1<k2$$

Figure 13:
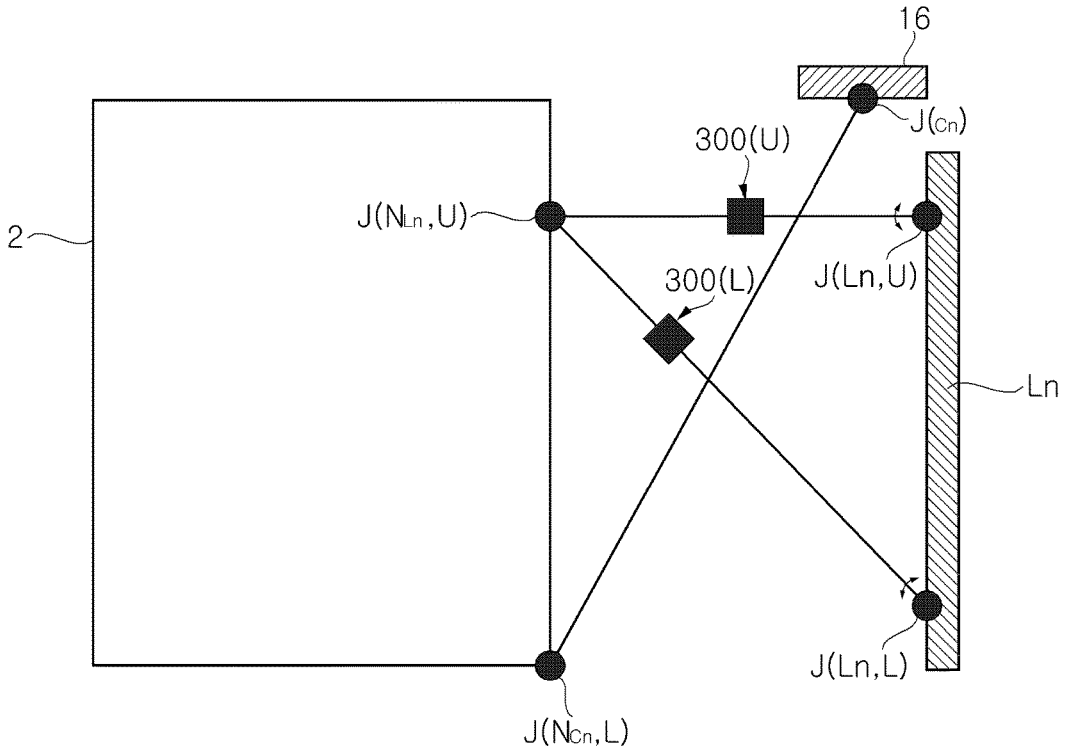
FIG. 13 is a view illustrating the configuration of horizontal vibration buffering devices of a washer according to a ninth embodiment of the present invention.

FIG. 13 is a view illustrating the configuration of horizontal vibration buffering devices of a washer according to a ninth embodiment of the present invention.

Each casing connecting part is a fixed connecting part rotationally coupled with a side surface ($L_n$) of main body 12. The casing connecting part J($L_n$,U) of the first horizontal vibration buffering device 300(U) may be connected with an upper part ($L_n$,U) at a side surface of main body 12, and the casing connecting part J($L_n$,L) of the second horizontal vibration buffering device 300(L) may be connected with a lower part ($L_n$,L) at a side surface of main body 12. However, without being limited thereto, as long as a relative arrangement may be specified in an upper-lower direction between the casing connecting part J($L_n$,U) of the first horizontal vibration buffering device 300(U) and the casing connecting part J($L_n$,L) of the second horizontal vibration buffering device 300(L), the position on the casing 10 where each casing connecting part is connected is not restricted.

The description given above in connection with the eighth embodiment may likewise apply to the combination and relation between the dampers and springs constituting the first horizontal vibration buffering device 300(U) and the second horizontal vibration buffering device 300(L), and therefore the detailed description thereof is skipped.

According to an embodiment of the present invention, the laundry treatment apparatus may more effectively scatter vibration or shock that is transferred from outer tub 2 by arranging the supporting rod connecting parts J(R,U) and J(R,L) of the horizontal vibration buffering devices 200(U) and 200(L) in an upper-lower direction with respect to each other. In particular, the laundry treatment apparatus may show further enhanced attenuation performance regarding vibration generated from the upper part of outer tub 2.

Table 2 summarizes the combinations of the first horizontal vibration buffering device 200(U) or 300(U) and the second horizontal vibration buffering device 200(L) or 300(L) as described above in connection with FIGS. 12 and 13.

TABLE 2

| | Outer tub connecting part (common in eighth and ninth embodiments) | Supporting rod connecting part (eighth embodiment) | Casing connecting part (ninth embodiment) |
|---|---|---|---|
| First horizontal vibration buffering device (200(U), 300(U)) | Upper part | Upper part | Upper part |
| Second horizontal vibration buffering device (200(L), 300(L)) | Upper part | Lower part | Lower part |

In the following embodiments described in connection with FIGS. 14 and 15, a first horizontal vibration buffering device 200(U) and a second horizontal vibration buffering device 200(L) each having an end (outer tub connecting part) connected with a lower part of outer tub 2 is provided, while the other end of the first horizontal vibration buffering device 200(U) is connected with an upper part of supporting rod 15 or an upper part of casing 10, and the other end of the second horizontal vibration buffering device 200(L) is connected with a lower part of supporting rod 15 or a lower part of casing 10.

Figure 14:
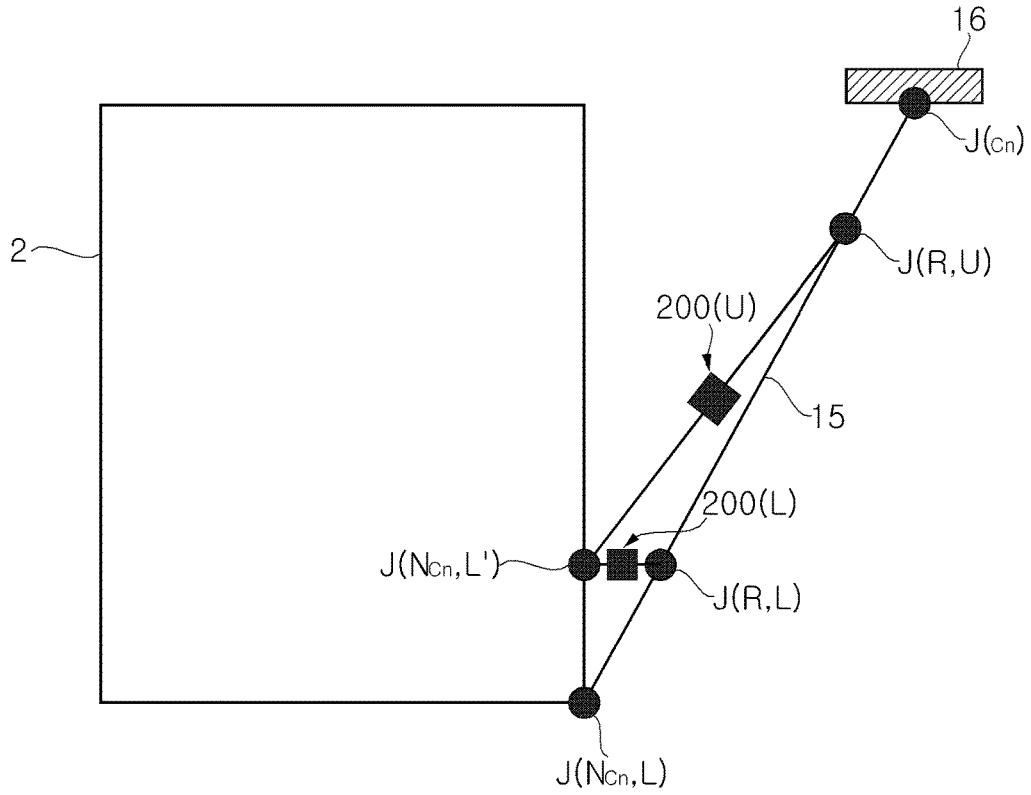
FIG. 14 is a view illustrating the configuration of horizontal vibration buffering devices of a washer according to a tenth embodiment of the present invention.

FIG. 14 is a view illustrating the configuration of horizontal vibration buffering devices of a washer according to a tenth embodiment of the present invention.

The washer according to this embodiment differs from the washer according to the eighth embodiment in that the first horizontal vibration buffering device 200(U) and the second horizontal vibration buffering device 200(L) each are connected with a lower part of the outer tub 2, but the other configurations are identical. Accordingly, the above description applies to the same configurations, and the detailed description of the same configuration is skipped.

Meanwhile, the outer tub connecting parts J($N_{Cn}$,L') of the first horizontal vibration buffering device 200(U) and the second horizontal vibration buffering device 200(L) are positioned at an upper side as compared with where supporting rods 15 are connected with outer tub 2 by vertical vibration buffering devices 30 (refer to FIG. 1) (hereinafter, referred to as a supporting rod-outer tub connecting part).

The laundry treatment apparatus according to the instant embodiment may more effectively scatter vibration or shock transferred from outer tub 2 by arranging the supporting rod connecting parts J(R,U) and J(R,L) of the horizontal vibration buffering devices 200(U) and 200(L) in an upper-lower direction with respect to each other. In particular, the laundry treatment apparatus may further enhance attenuation performance regarding vibration generated from a lower part of outer tub 2.

Figure 15:
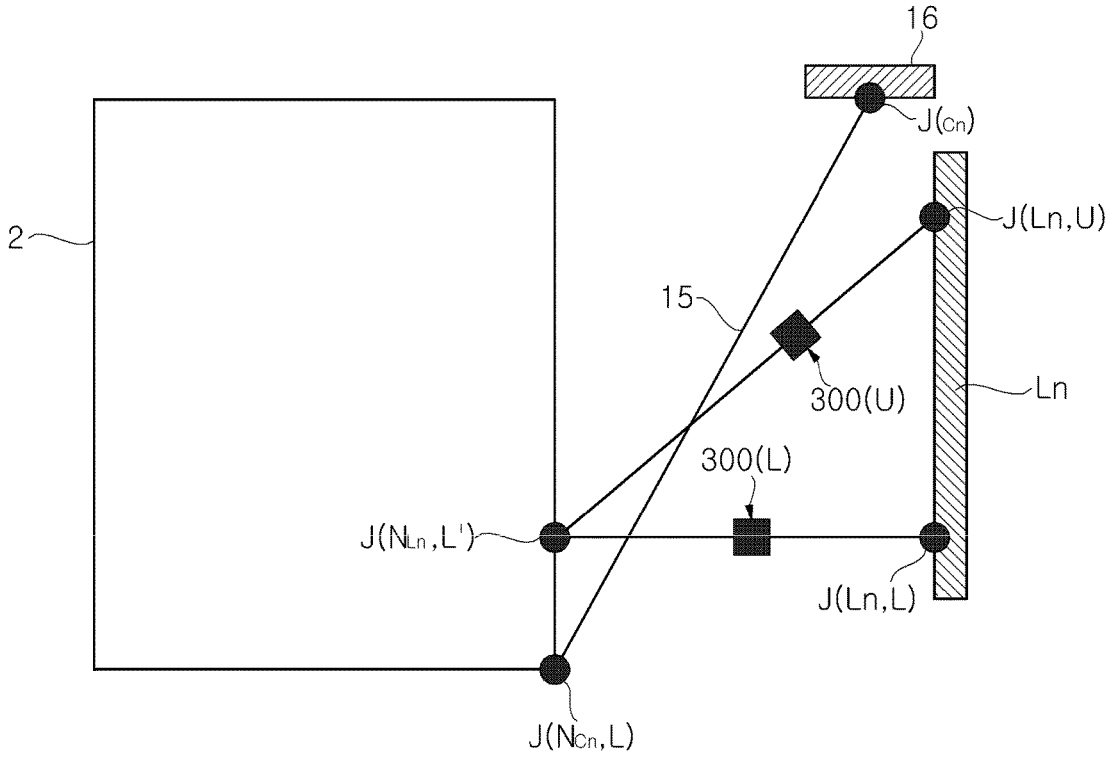
FIG. 15 is a view illustrating the configuration of horizontal vibration buffering devices of a washer according to an eleventh embodiment of the present invention.

FIG. 15 is a view illustrating the configuration of horizontal vibration buffering devices of a washer according to an eleventh embodiment of the present invention.

The washer according to this embodiment differs from the washer according to the eighth embodiment in that the first horizontal vibration buffering device 300(U) and the second horizontal vibration buffering device 300(L), respectively, have casing connecting parts J($L_n$,U) and J($L_n$,L), otherwise the other configurations are similar.

Since outer tub 2 is hung by supporting rods 15 in the casing 10, pivoting is performed with respect to the casing connecting parts J(Cn) of supporting rods 15. In this embodiment, since outer tub 2 is connected with casing 10 by the first horizontal vibration buffering device 300(U) and the second horizontal vibration buffering device 300(L), the attenuation force provided by the horizontal vibration buffering devices 300(U) and 300(L) may be directly exerted to outer tub 2, and the pivoting at the casing connecting parts J(Cn) is also further restricted, thus leading to the overall system being further stabilized.

Table 3 summarizes the combinations of the first horizontal vibration buffering device 200(U) or 300(U) and the second horizontal vibration buffering device 200(L) or 300(L) as described above in connection with FIGS. 14 and 15.

TABLE 3

| | Outer tub connecting part (common in tenth and eleventh embodiments) | Supporting rod connecting part (tenth embodiment) | Casing connecting part (eleventh embodiment) |
|---|---|---|---|
| First horizontal vibration buffering device (200(U), 300(U)) | Lower part | Upper part | Upper part |
| Second horizontal vibration buffering device (200(L), 300(L)) | Lower part | Lower part | Lower part |

Figure 16:
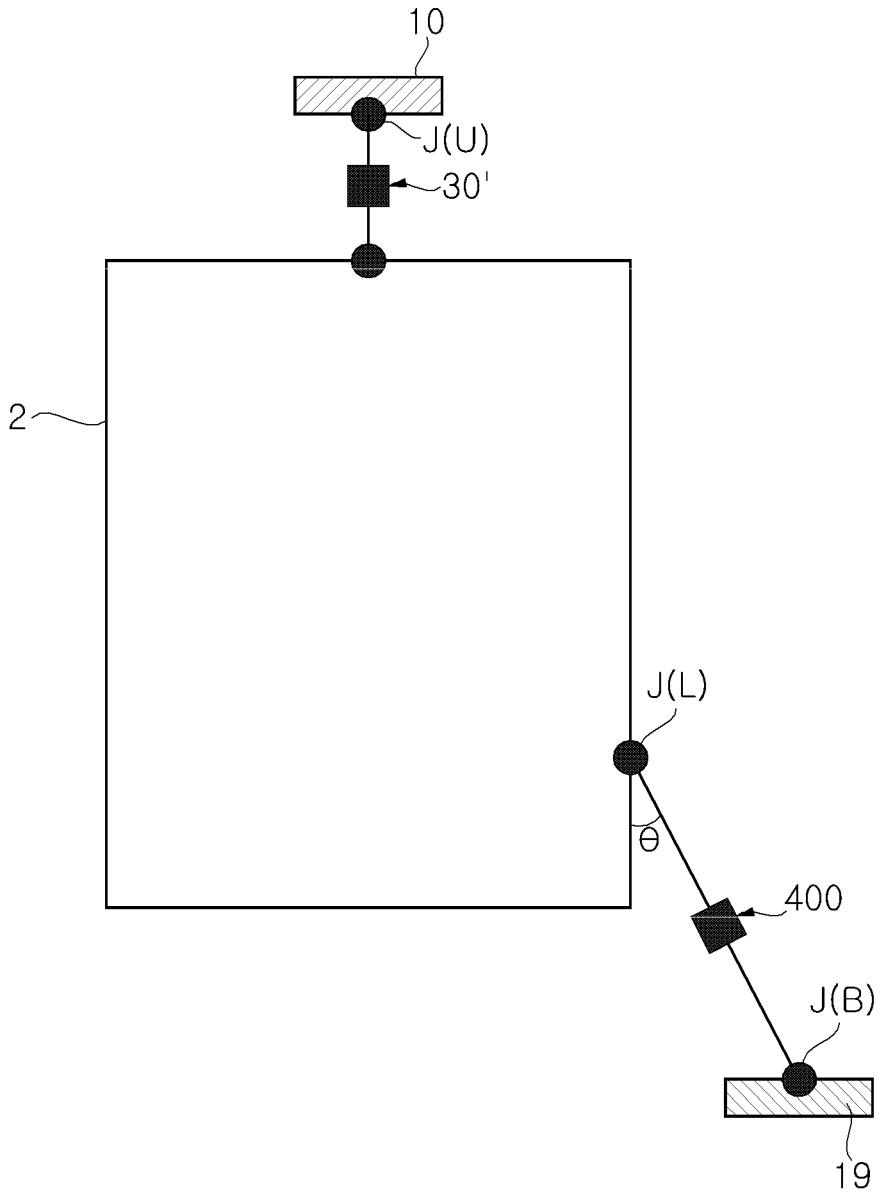
FIG. 16 is a view illustrating the configuration of horizontal vibration buffering devices of a washer according to a twelfth embodiment of the present invention.

FIG. 16 is a view illustrating the configuration of horizontal vibration buffering devices of a washer according to a twelfth embodiment of the present invention.

In this embodiment, the washer includes a vertical vibration buffering device 30' connecting an upper part of outer tub 2 with an upper part of casing 10 and a horizontal vibration buffering device 400 connecting a lower part L of outer tub 2 with a lower part of casing 10.

Vertical vibration buffering device 30' extends substantially in a vertical direction to mitigate vertical vibration of outer tub 2. Vertical vibration buffering device 30' may include at least one of a spring and a damper. Vertical vibration buffering device 30' may be actually implemented by upwardly moving a position where supporting rod 15 is connected with outer tub 2. Vertical vibration buffering device 30' may include a casing connecting part J(U) pivotably connected with top cover 14.

Horizontal vibration buffering device 400 connects the lower part of outer tub 2 with the lower part of casing 10. Horizontal vibration buffering device 400 may include an outer tub connecting part J(L) connected with a side surface of outer tub 2 and a casing connecting part J(B) connected with base 19 of casing 10. The outer tub connecting part J(L) may be rotatably coupled with outer tub 2, and the casing connecting part J(B) may be rotatably connected with casing 10.

In particular, since the washer according to this embodiment is hung by vertical vibration buffering device 30' in casing 10, the center of mass of outer tub 2 is positioned lower than the upper part of outer tub 2 connected with vertical vibration buffering device 30'. Accordingly, larger horizontal vibration is generated at the lower part of outer tub 2, and to mitigate the vibration, horizontal vibration buffering device 400 is connected with the lower part of outer tub 2.

Horizontal vibration buffering device 400 may include at least one of a spring and a damper. The direction along which the spring or damper causes a displacement forms a predetermined angle Θ with respect to the vertical direction. Here, Θ is an acute angle.

Figure 17:
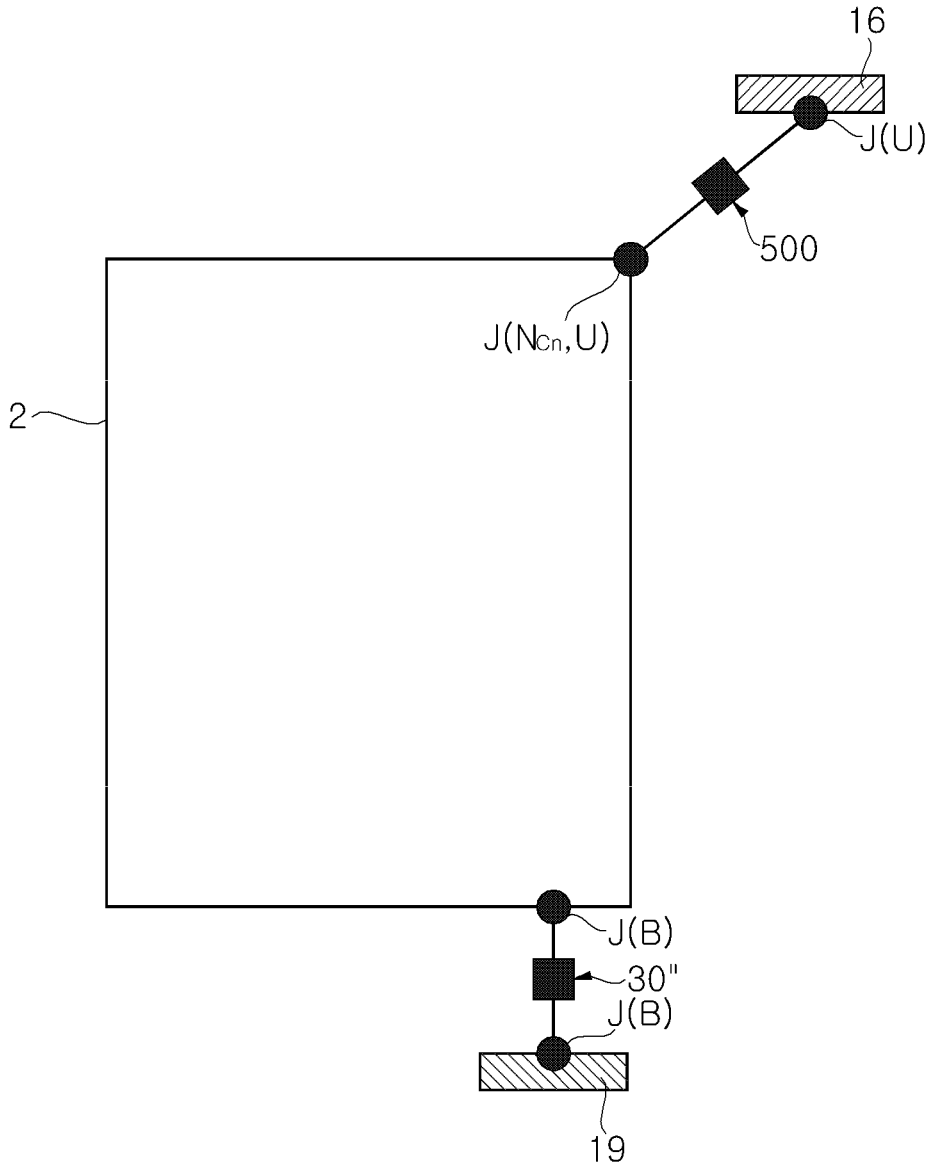
FIG. 17 is a view illustrating the configuration of horizontal vibration buffering devices of a washer according to a thirteenth embodiment of the present invention.

FIG. 17 is a view illustrating the configuration of horizontal vibration buffering devices of a washer according to a thirteenth embodiment of the present invention.

The washer according to this embodiment includes a horizontal vibration buffering device 500 connecting an upper part of outer tub 2 with an upper part of casing 10 and a vertical vibration buffering device 30" connecting a bottom of outer tub 2 with base 19 of casing 10.

Vertical vibration buffering device 30" extends substantially in a vertical direction to mitigate vertical vibration of outer tub 2. Vertical vibration buffering device 30" may include at least one of a spring and a damper.

Horizontal vibration buffering device 500 connects the upper part of outer tub 2 with the upper part of casing 10. Horizontal vibration buffering device 500 may include an outer tub connecting part $J(N_{Cn},U)$ connected with the upper part of outer tub 2 and a casing connecting part J(U) connected with the upper part of casing 10. The outer tub connecting part $J(N_{Cn},U)$ may be rotatably connected with respect to outer tub 2, and the casing connecting part J(U) may be pivotably connected with respect to pivot support 16.

Horizontal vibration buffering device 500 may include at least one of a spring and a damper. The direction along which the spring or damper causes a displacement forms a predetermined angle Θ with respect to the vertical direction. Here, Θ is an acute angle.

Figure 18:
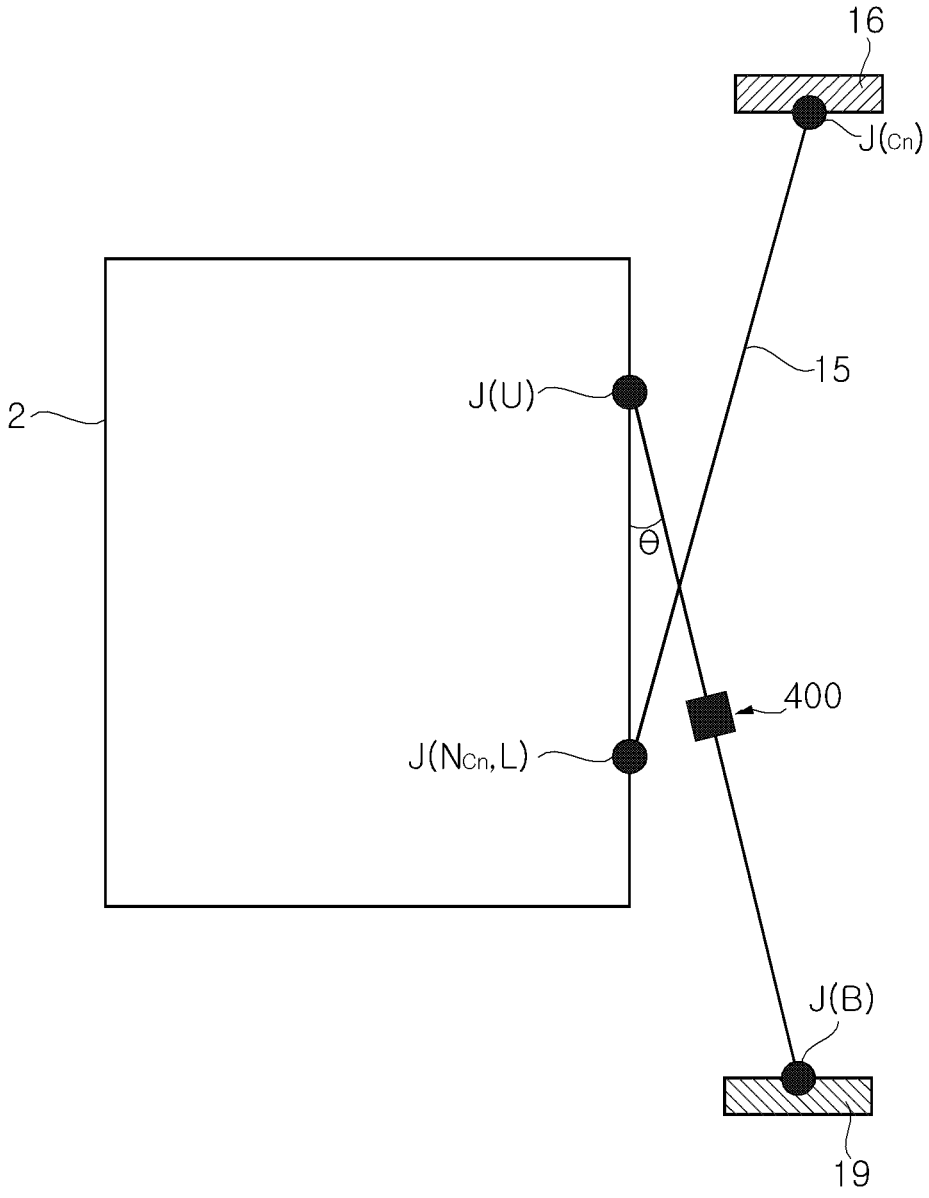
FIG. 18 is a view illustrating the configuration of horizontal vibration buffering devices of a washer according to a fourteenth embodiment of the present invention.

FIG. 18 is a view illustrating the configuration of horizontal vibration buffering devices of a washer according to a fourteenth embodiment of the present invention.

The washer according to the instant embodiment includes a horizontal vibration buffering device 400 connecting an upper part of outer tub 2 with a bottom of casing 10. The outer tub connecting part J(U) of horizontal vibration buffering device 400 is positioned at a higher side than the supporting rod-outer tub connecting part $J(N_{Cn}, L)$.

Horizontal vibration buffering device 400 may include at least one of a damper and a spring, and the direction along which the spring or damper causes a displacement forms a predetermined angle Θ with respect to the vertical direction. Here, Θ is an acute angle.

Horizontal vibration buffering device 400 according to this embodiment may not only attenuate horizontal vibration at an upper part of outer tub 2, but horizontal vibration buffering device 400, together with vertical vibration buffering device 30 (refer to FIG. 1) provided at supporting rod 15, also provides an attenuation force against the vertical vibration of outer tub 2. In particular, in case horizontal vibration buffering device 400 includes a spring, the extension and contraction of the spring is made in an opposite direction of the spring of the vertical vibration buffering device 30. Thus, the buffering operation may be more stably performed. For example, when outer tub 2 is displaced to a lower part by vibration, the length of horizontal vibration buffering device 400 shrinks but the spring of the vertical vibration buffering device 30 extends. When outer tub 2 is displaced to an upper part, the opposite situation occurs. Accordingly, stability and stiffness may be secured for both upper and lower directions of outer tub 2.

Figure 19:
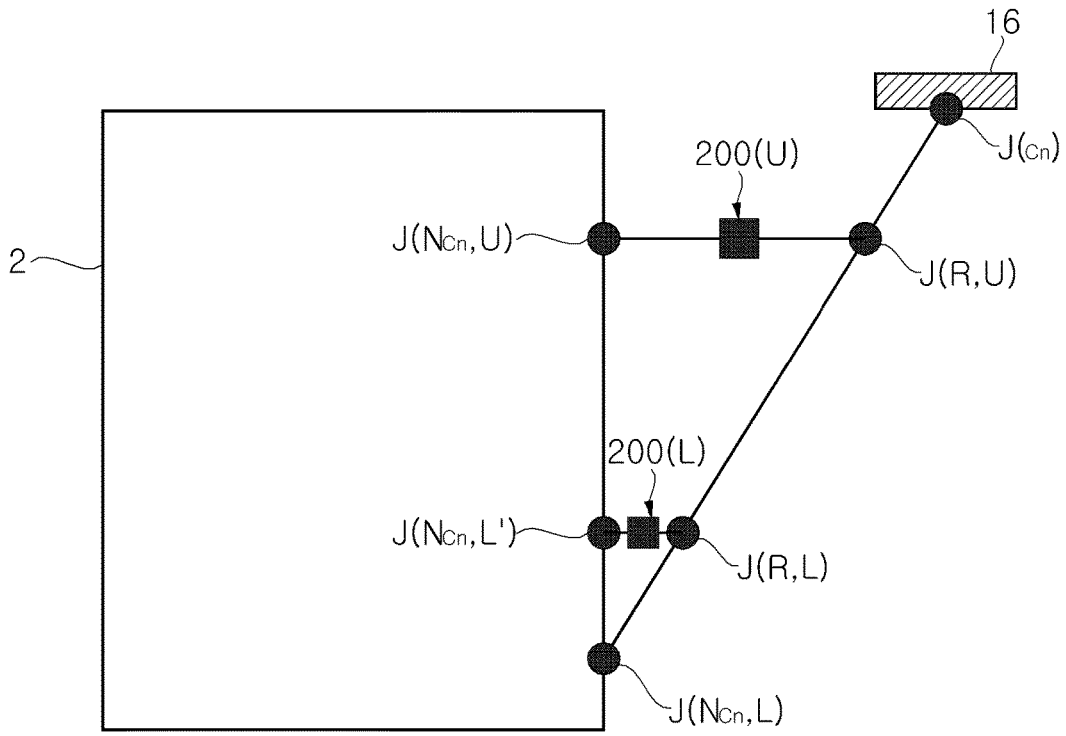
FIG. 19 is a view illustrating the configuration of horizontal vibration buffering devices of a washer according to a fifteenth embodiment of the present invention.

FIG. 19 is a view illustrating the configuration of horizontal vibration buffering devices of a washer according to a fifteenth embodiment of the present invention.

The washer according to this embodiment includes an upper horizontal vibration buffering device 200(U) and a lower horizontal vibration buffering device 200(L) that respectively mitigate vibration at an upper part and a lower part of outer tub 2.

Each of the horizontal vibration buffering devices 200(U) and 200(L) has an outer tub connecting part and a supporting rod connecting part.

The outer tub connecting part $J(N_{Cn},U)$ of upper horizontal vibration buffering device 200(U) may be connected with an upper corner facing point $N_{Cn}$,U of outer tub 2. The horizontal vibration at the upper part of outer tub 2 is reduced primarily by upper horizontal vibration buffering device 200(U).

The outer tub connecting part $J(N_{Cn},L)$ of lower horizontal vibration buffering device 200(L) may be connected with a lower corner facing point $N_{Cn}$,L of outer tub 2. The horizontal vibration at the upper part of outer tub 2 is reduced primarily by lower horizontal vibration buffering device 200(L).

The supporting rod connecting part J(R,U) of upper horizontal vibration buffering device 200(U) is connected to supporting rod 15 at a lower side as compared with the supporting rod connecting part J(R,L) of lower horizontal vibration buffering device 200(L). Each supporting rod connecting part J(R,U) and J(R,L) may be rotatable with respect to the horizontal axis while fixed to a position on supporting rod 15. However, the present invention is not limited thereto. Preferably, each supporting rod connecting part J(R,U) and J(R,L) may be rotatable with respect to the horizontal axis while movable along supporting rod 15. Even in such case, however, the supporting rod connecting part J(R,U) of upper horizontal vibration buffering device 200(U) is moved in an upper section as compared with the supporting rod connecting part J(R,L) of lower horizontal vibration buffering device 200(L).

Each horizontal vibration buffering device 200(U) and 200(L) may include at least one of a spring and a damper.

According to an embodiment, upper horizontal vibration buffering device 200(U) and lower horizontal vibration buffering device 200(L) each may have a damper. In such a case, the attenuation constant of upper horizontal vibration buffering device 200(U) is preferably larger than the attenuation constant of lower horizontal vibration buffering device 200(L) so that a larger attenuation force may be generated by upper horizontal vibration buffering device 200(U).

According to another embodiment, upper horizontal vibration buffering device 200(U) may include a damper, and lower horizontal vibration buffering device 200(L) may include a spring. In such a case, vibration is attenuated by the upper horizontal vibration buffering device 200(U), and the spring of lower horizontal vibration buffering device 200(L) provides an elastic force that returns the damper to its original state.

According to still another embodiment, upper horizontal vibration buffering device 200(U) and lower horizontal vibration buffering device 200(L) each include a damper and a spring, so that upper horizontal vibration buffering device 200(U) exerts a larger attenuation force than lower horizontal vibration buffering device 200(L) while the lower horizontal vibration buffering device 200(L) provides a larger stiffness than upper horizontal vibration buffering device 200(U). Assuming that the attenuation constant and spring constant of upper horizontal vibration buffering device 200 (U) are c1 and k1, respectively, and the attenuation constant and spring constant of lower horizontal vibration buffering device 200(L) are c2 and k2, respectively, the following relation is established:

$$c1>c2, k1<k2$$

Figure 20:
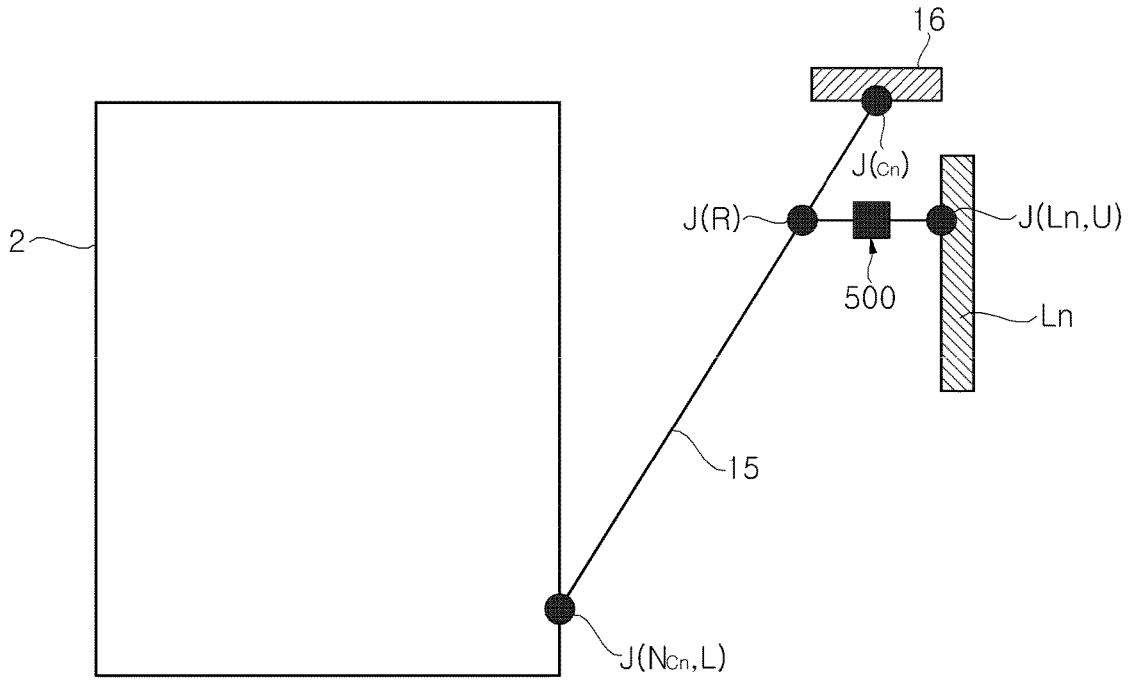
FIG. 20 is a view illustrating the configuration of horizontal vibration buffering devices of a washer according to a sixteenth embodiment of the present invention.

FIG. 20 is a view illustrating the configuration of horizontal vibration buffering devices of a washer according to a sixteenth embodiment of the present invention.

The washer according to this embodiment includes a horizontal vibration buffering device 500 connecting a supporting rod 15 with a casing 10. Horizontal vibration buffering device 500 may include a supporting rod connecting part J(R) connected to be movable along supporting rod 15 and a casing connecting part $J(L_n,U)$ fixedly connected to casing 10.

The supporting rod connecting part J(R) may be not only movable along supporting rod 15 but also rotatable with respect to the horizontal axis. Horizontal vibration buffering device 500 may include at least one of a damper and a spring, and in particular when horizontal vibration buffering device 500 includes a damper, the horizontal vibration of outer tub 2 is attenuated by an attenuation force from the damper.

Considering the structure in which the lower part of outer tub 2 is connected with supporting rod 15, a large displacement occurs due to vibration at the upper part of the outer tub 2. Accordingly, the casing connecting part $J(L_n,U)$ is preferably connected with an upper part U of a side surface $L_n$ of main body 12.

Figure 21:
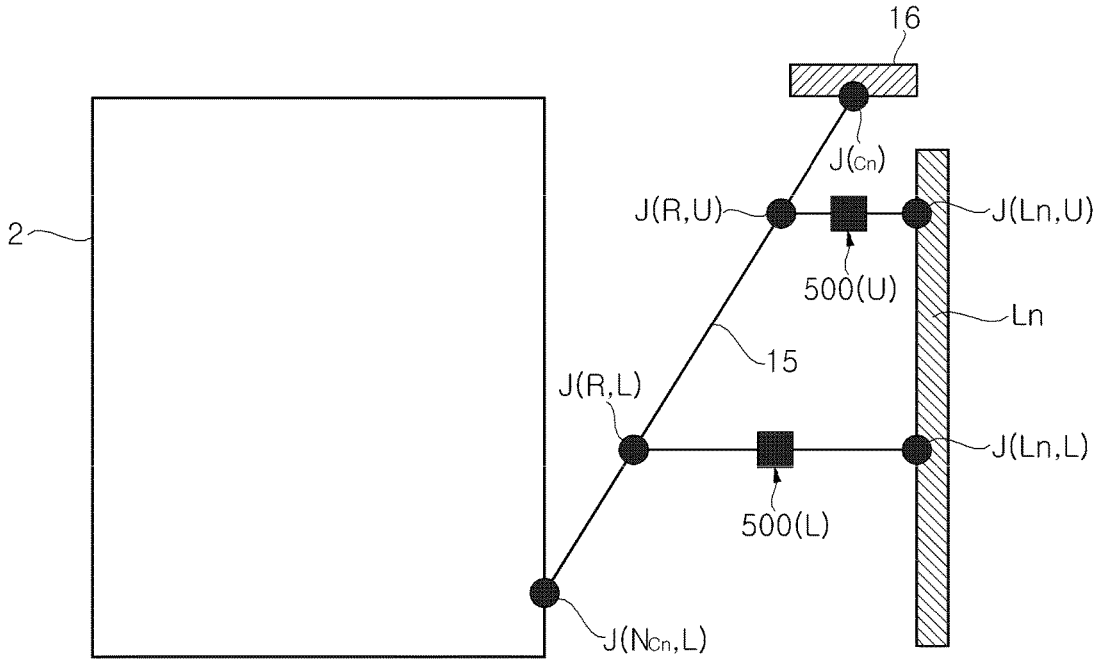
FIG. 21 is a view illustrating the configuration of horizontal vibration buffering devices of a washer according to a seventeenth embodiment of the present invention.

FIG. 21 is a view illustrating the configuration of horizontal vibration buffering devices of a washer according to a seventeenth embodiment of the present invention.

The washer according to this embodiment includes an upper horizontal vibration buffering device 500(U) and a lower horizontal vibration buffering device 500(L) each connecting supporting rod 15 with casing 10.

Upper horizontal vibration buffering device 500(U) and lower horizontal vibration buffering device 500(L) each have a supporting rod connecting part and a casing connecting part.

The supporting rod connecting part J(R,U) of upper horizontal vibration buffering device 500(U) is connected with supporting rod 15 at an upper side as compared with the supporting rod connecting part J(R,L) of lower horizontal vibration buffering device 500(L). Each supporting rod connecting part J(R,U) and J(R,L) may be rotatable with respect to the horizontal axis while fixed to a position on supporting rod 15. However, the present invention is not limited thereto. Preferably, each of the supporting rod connecting parts J(R,U) and J(R,L) may be movably provided along the supporting rod 15, so as to be rotatable with respect to the horizontal axis. Even in such case, however, the supporting rod connecting part J(R,U) of upper horizontal vibration buffering device 500(U) is moved in an upper section as compared with the supporting rod connecting part J(R,L) of lower horizontal vibration buffering device 500 (L).

The casing connecting part $J(L_n,U)$ of upper horizontal vibration buffering device 200(U) may be connected with an upper part of casing 10. Preferably, the casing connecting part $J(L_n,U)$ is connected with an upper part U of a side surface Ln of main body 12.

The casing connecting part $J(L_n,L)$ of the lower horizontal vibration buffering device 200(L) may be connected with a lower part of the casing 10. Preferably, the casing connecting part $J(L_n,U)$ is connected with a lower part L of the side surface $L_n$ of the cabinet 12.

Each of the horizontal vibration buffering devices 200(U) and 200(L) may include at least one of a spring and a damper.

According to an embodiment, upper horizontal vibration buffering device 200(U) and lower horizontal vibration buffering device 200(L) each may include a damper. In such a case, the attenuation constant of upper horizontal vibration buffering device 200(U) is preferably larger than the attenuation constant of lower horizontal vibration buffering device 200(L) so that a larger attenuation force may be generated by upper horizontal vibration buffering device 200(U).

According to another embodiment, upper horizontal vibration buffering device 200(U) may include a damper, and lower horizontal vibration buffering device 200(L) may include a spring. In such a case, vibration is attenuated by upper horizontal vibration buffering device 200(U) and the spring of lower horizontal vibration buffering device 200(L) provides an elastic force that returns the damper to its original state.

According to still another embodiment, each of the upper horizontal vibration buffering device 200(U) and the lower horizontal vibration buffering device 200(L) includes a damper and a spring, so that upper horizontal vibration buffering device 200(U) exerts a larger attenuation force as compared with lower horizontal vibration buffering device 200(L), while lower horizontal vibration buffering device 200(L) provides a larger stiffness than upper horizontal vibration buffering device 200(U). In other words, assuming the attenuation constant and spring constant of upper horizontal vibration buffering device 200(U) are c1 and k1, respectively, and the attenuation constant and spring constant of lower horizontal vibration buffering device 200(L) are c2 and k2, respectively, the following relation is established:

$$c1>c2, k1<k2$$

Figure 22:
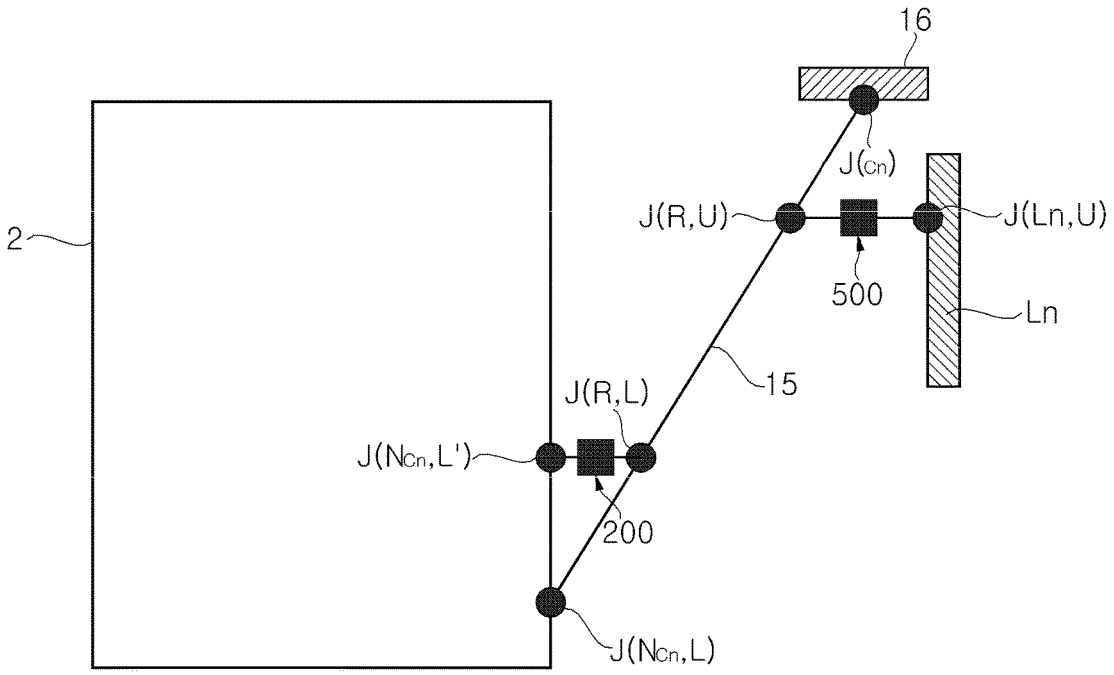
FIG. 22 is a view illustrating the configuration of horizontal vibration buffering devices of a washer according to an eighteenth embodiment of the present invention.

FIG. 22 is a view illustrating the configuration of horizontal vibration buffering devices of a washer according to an eighthteenth embodiment of the present invention.

The washer according to this embodiment include an upper horizontal vibration buffering device 500 and a lower horizontal vibration buffering device 200.

Any one of the upper horizontal vibration buffering device 500 and the lower horizontal vibration buffering device 200 has an outer tub connecting part $J(N_{Cn},L')$ and a supporting rod connecting part J(R,L), and the other has a supporting rod connecting part J(R,U) and a casing connecting part $J(L_n,U)$.

The supporting rod connecting part J(R,U) of upper horizontal vibration buffering device 500 is connected with supporting rod 15 at an upper side as compared with the supporting rod connecting part J(R,U) of lower horizontal vibration buffering device 200. Each supporting rod connecting part J(R,U) and J(R,L) may be rotatable with respect to the horizontal axis while fixed to a position on supporting rod 15. However, the present invention is not limited thereto. Preferably, the supporting rod connecting parts may be provided movably along supporting rod 15 so as to be rotatable with respect to the horizontal axis. Even in such case, however, the supporting rod connecting part J(R,U) of upper horizontal vibration buffering device 500 is moved in an upper section as compared with the supporting rod connecting part J(R,L) of lower horizontal vibration buffering device 200.

Each horizontal vibration buffering device 500 and 200 may include at least one of a spring and a damper.

Meanwhile, the outer tub connecting part $J(N_{Cn},L')$ of lower horizontal vibration buffering device 200 is positioned at an upper side as compared with the supporting rod-outer tub connecting part $J(N_{Cn},L)$ where supporting rod 15 is connected with outer tub 2 by a vertical vibration buffering device 30 (refer to FIG. 1).

The casing connecting part $J(L_n,U)$ may be connected with the upper part of casing 10. Preferably, the casing connecting part is connected with the upper part at a side surface $L_n$ of main body 12.

Preferably, in case any one of upper horizontal vibration buffering device 500 and lower horizontal vibration buffering device 200 includes a damper, the other includes a spring that offers an elastic force to return the damper to its original position. Since the attenuation force (or elastic force) exerted by upper horizontal vibration buffering device 500 is oriented substantially in parallel with the elastic force (or attenuation force) exerted by lower horizontal vibration buffering device 200, the elastic energy retained in the spring may be more effectively used to bring the damper to its original position.

The laundry treatment apparatus according to the embodiments of the present invention may reduce the horizontal vibration of the outer tub.

Further, the laundry treatment apparatus according to the embodiments of the present invention may increase capacity of the outer tub.

Still further, the laundry treatment apparatus according to the embodiments of the present invention may prevent collision between the outer tub and the casing, thus leading to an enhancement in durability and prevention of abnormal noise.

Yet still further, the laundry treatment apparatus according to the embodiments of the present invention may quickly attenuate vibration of the outer tub even when the laundry is rendered eccentric to a certain degree, thus reducing the driving time to distribute the laundry. Accordingly, considering the fact that a laundry distribution operation is typically performed for changing the positions of the laundry in the inner tub in order to control the vibration of the outer tub to a predetermined level or lower for entrance into the dehydration process, the time required for entering into the dehydration process may be reduced.

Although the preferred embodiments of the present invention have been disclosed for illustrative purposes, those skilled in the art will appreciate that various modifications, additions and substitutions are possible, without departing from the scope and spirit of the invention.

What is claimed is:

1. A laundry treatment apparatus, comprising:

a casing;

an outer tub suspended in the casing;

a pair of supporting rods respectively coupling opposite corners of the casing with a lower part of the outer tub; and a pair of horizontal vibration buffering devices arranged to form opposite angles relative each other in the casing, the horizontal vibration buffering devices each coupling the supporting rod and each having a portion coupled with the outer tub to be displaced relative a portion coupled with the supporting rod as the outer tub vibrates, wherein the pair of horizontal vibration buffering devices each provide an attenuation force according to the displacement, and wherein, for each horizontal vibration buffering device, a virtual line from the portion coupled with the outer tub to the portion coupled with the supporting rod forms an acute angle with respect to a tangent of a circumference of the outer tub in a stationary state, at a position where the horizontal vibration buffering devices is connected, wherein the portion coupled with the outer tub is rotatable about a substantially vertical axis.

2. The laundry treatment apparatus of claim 1, wherein each of the pair of horizontal vibration buffering devices comprises:

a casing connecting part coupled to a corner of the casing;

an outer tub connecting part coupled to the outer tub, the outer tub connecting part having a displacement relative the casing connecting part as the outer tub vibrates; and a damper providing an attenuation force according to the displacement of the outer tub connecting part relative the casing connecting part.

3. The laundry treatment apparatus of claim 2, further comprising:

a supporting rod suspending the outer tub to the casing, the supporting rod having an end coupled to a corner of the casing; and a vertical vibration buffering device coupling another end of the supporting rod with a lower part of the outer tub, the vertical vibration buffering device mitigating vertical vibration of the outer tub, wherein a position where the outer tub connecting part is coupled to the outer tub is vertically higher than the position where the supporting rod is coupled to the outer tub.

4. The laundry treatment apparatus of claim 2, wherein a line connecting the outer tub connecting part with the casing connecting part is perpendicular to a tangent of a circumference of the outer tub at a position where the outer tub connecting part is connected.

5. The laundry treatment apparatus of claim 2, wherein a line connecting the outer tub connecting part with the casing connecting part forms an acute angle with respect to a tangent of a circumference of the outer tub at a position where the outer tub connecting part is connected.

6. The laundry treatment apparatus of claim 1, wherein each of the pair of horizontal vibration buffering devices comprises:

a supporting rod connecting part coupled to the supporting rod;

an outer tub connecting part coupled to the outer tub and having a displacement relative the supporting rod connecting part as the outer tub vibrates; and a damper providing an attenuation force according to the displacement of the outer tub connecting part relative the supporting rod connecting part.

7. The laundry treatment apparatus of claim 6, wherein the supporting rod connecting part is moveable along the supporting rod.

8. The laundry treatment apparatus of claim 7, wherein the supporting rod connecting part rotates relative a horizontal axis.

9. The laundry treatment apparatus of claim 6, wherein a line connecting the outer tub connecting part with the supporting rod connecting part is perpendicular to a tangent of a circumference of the outer tub at a position where the outer tub connecting part is connected.

10. The laundry treatment apparatus of claim 6, wherein at least one of the pair of horizontal vibration buffering devices further comprises:

a spring providing an elastic force according to the displacement of the outer tub connecting part relative the casing connecting part.

11. The laundry treatment apparatus of claim 2, wherein a position where the outer tub connecting part of any one horizontal vibration buffering device of the pair of horizontal vibration buffering devices is connected with the outer tub is symmetrical with a position where the outer tub connecting part of the other horizontal vibration buffering device of the pair of horizontal vibration buffering devices is connected with the outer tub, relative a center of the outer tub.

12. The laundry treatment apparatus of claim 2, wherein the damper of any one horizontal vibration buffering device of the pair of horizontal vibration buffering devices has the same attenuation constant as the damper of the other horizontal vibration buffering device of the pair of horizontal vibration buffering devices.

13. A laundry treatment apparatus, comprising:

a casing;

an outer tub suspended in the casing;

four supporting rods respectively coupling four corners of the casing with a lower part of the outer tub; and four horizontal vibration buffering devices, wherein a pair of the horizontal vibration buffering devices are arranged in the casing to face another pair of the horizontal vibration buffering devices to form opposite angles relative each other, each of the horizontal vibration buffering devices coupling the supporting rod with the outer tub, wherein a portion of each horizontal vibration buffering device connected with the outer tub relative a portion of each horizontal vibration buffering device connected with the supporting rod has a displacement as the outer tub vibrates, wherein each of the four horizontal vibration buffering devices provides an attenuation force according to the displacement, and wherein, for each horizontal vibration buffering device, a virtual line from the portion coupled with the outer tub to the portion coupled with the supporting rod forms an acute angle with respect to a tangent of a circumference of the outer tub in a stationary state, at a position where the horizontal vibration buffering devices is connected, wherein the portion coupled with the outer tub is rotatable about a substantially vertical axis.

14. The laundry treatment apparatus of claim 13, wherein each of the four horizontal vibration buffering devices comprises:

a casing connecting part coupled to a corner of the casing;

an outer tub connecting part coupled to the outer tub, the outer tub connecting part having a displacement relative the casing connecting part as the outer tub vibrates; and a damper providing an attenuation force according to the displacement of the outer tub connecting part with respect to the casing connecting part.

15. The laundry treatment apparatus of claim 14, wherein each of a pair of horizontal vibration buffering devices are arranged to form opposite angles relative each other in the casing and each further comprises:

a spring providing an elastic force according to the displacement of the outer tub connecting part relative the casing connecting part.

16. The laundry treatment apparatus of claim 14, wherein any one of a pair of horizontal vibration buffering devices arranged to form opposite angles relative each other in the casing further comprises:

a spring providing an elastic force according to the displacement of the outer tub connecting part relative the casing connecting part.

17. The laundry treatment apparatus of claim 14, further comprising:

a supporting rod suspending the outer tub to the casing, the supporting rod having an end coupled to a corner of the casing; and a vertical vibration buffering device coupling another end of the supporting rod with a lower part of the outer tub, the vertical vibration buffering device mitigating vertical vibration of the outer tub, wherein a position where the outer tub connecting part is coupled to the outer tub is vertically higher than the position where the supporting rod is coupled to the outer tub.

18. The laundry treatment apparatus of claim 13, wherein each of the four horizontal vibration buffering devices comprises:

a supporting rod connecting part coupled to the supporting rod;

an outer tub connecting part coupled to the outer tub and having a displacement relative the supporting rod connecting part as the outer tub vibrates; and a damper providing an attenuation force according to the displacement of the outer tub connecting part relative the supporting rod connecting part.

19. The laundry treatment apparatus of claim 18, wherein the supporting rod connecting part is moveable along the supporting rod.

20. The laundry treatment apparatus of claim 19, wherein the supporting rod connecting part rotates relative a horizontal axis.

21. The laundry treatment apparatus of claim 14, wherein the dampers of the four horizontal vibration buffering devices have the same attenuation constant.

* * * * *